US012048386B2

(12) United States Patent
Maurice et al.

(10) Patent No.: US 12,048,386 B2
(45) Date of Patent: Jul. 30, 2024

(54) ASSEMBLY, DEVICE, SYSTEM AND METHOD FOR DONNING A COMPRESSIVE GARMENT

(71) Applicant: TheHelpSoq Holding B.V., Arnhem (NL)

(72) Inventors: Ingmar Christiaan Maurice, Amsterdam (NL); Daniël Eric Ariëns, Zeist (NL); Herman Van Der Vegt, Utrecht (NL)

(73) Assignee: TheHelpSoq Holding B.V., Arnhem (NL)

( * ) Notice: Subject to any disclaimer, the term of this patent is extended or adjusted under 35 U.S.C. 154(b) by 0 days.

(21) Appl. No.: 17/921,694

(22) PCT Filed: Mar. 15, 2021

(86) PCT No.: PCT/NL2021/050174

§ 371 (c)(1),
(2) Date: Oct. 27, 2022

(87) PCT Pub. No.: WO2021/221494

PCT Pub. Date: Nov. 4, 2021

(65) Prior Publication Data

US 2023/0172378 A1 Jun. 8, 2023

(30) Foreign Application Priority Data

Apr. 28, 2020 (NL) ..... 2025439

(51) Int. Cl.
*A47G 25/90* (2006.01)

(52) U.S. Cl.
CPC ..... *A47G 25/905* (2013.01)

(58) Field of Classification Search
CPC ..... A47G 25/905
(Continued)

(56) References Cited

U.S. PATENT DOCUMENTS 1,315,096 A * 9/1919 Deiley ..... A47G 25/905 223/111
4,497,424 A * 2/1985 Smith ..... A47G 25/905 223/111

(Continued)

FOREIGN PATENT DOCUMENTS

CN 209316255 U 8/2019
DE 3914824 A1 11/1990

(Continued)

OTHER PUBLICATIONS

International Search Report and Written Opinion -PCT/NL2021/050174—mailing date Apr. 11, 2021.

*Primary Examiner* — Shaun R Hurley
(74) *Attorney, Agent, or Firm* — Banner & Witcoff, Ltd.

(57) ABSTRACT

Assembly (2) for donning a compressive garment (4), comprising a set of ring sections (6, 6') together forming an openable closed ring structure (8) which extends around a main ring axis (R), said ring structure (8) comprising a circumferential wall (10) for receiving a stretched compressive garment (4) thereon, wherein the ring structure (8) is configured for resisting radial compression of the circumferential wall (10) by the received garment (4), wherein at least two of the ring sections (6, 6') are moveable with respect to each other for opening the ring structure (8), wherein at least one passage (12*a*, 12*b*) is provided in the circumferential wall (10) of the closed ring structure (8).

25 Claims, 16 Drawing Sheets

(58) Field of Classification Search
USPC ..... D2/641
See application file for complete search history.

(56) References Cited

U.S. PATENT DOCUMENTS

| | | | | |
|---|---|---|---|---|
| 6,234,369 | B1 * | 5/2001 | Bort | A47G 25/905 223/111 |
| 6,536,636 | B1 * | 3/2003 | McDonniel | A47G 25/905 223/111 |
| 10,076,203 | B1 * | 9/2018 | Parrella | A47G 25/905 |
| 2009/0120975 | A1 * | 5/2009 | Schoepe | A47G 25/905 223/111 |
| 2009/0126082 | A1 * | 5/2009 | Janes | A61F 15/004 223/111 |
| 2010/0147908 | A1 * | 6/2010 | Skerman | A47G 25/905 223/111 |
| 2015/0136815 | A1 * | 5/2015 | Clifton | A47G 25/90 223/112 |
| 2018/0242767 | A1 * | 8/2018 | Herzig | A47G 25/905 |

FOREIGN PATENT DOCUMENTS

| | | | | | |
|---|---|---|---|---|---|
| GB | 781695 | A | | 8/1957 | |
| JP | 2005125050 | A | | 5/2005 | |
| JP | 2011004875 | A | * | 1/2011 | A47G 25/905 |
| WO | 03082062 | A1 | | 10/2003 | |

* cited by examiner

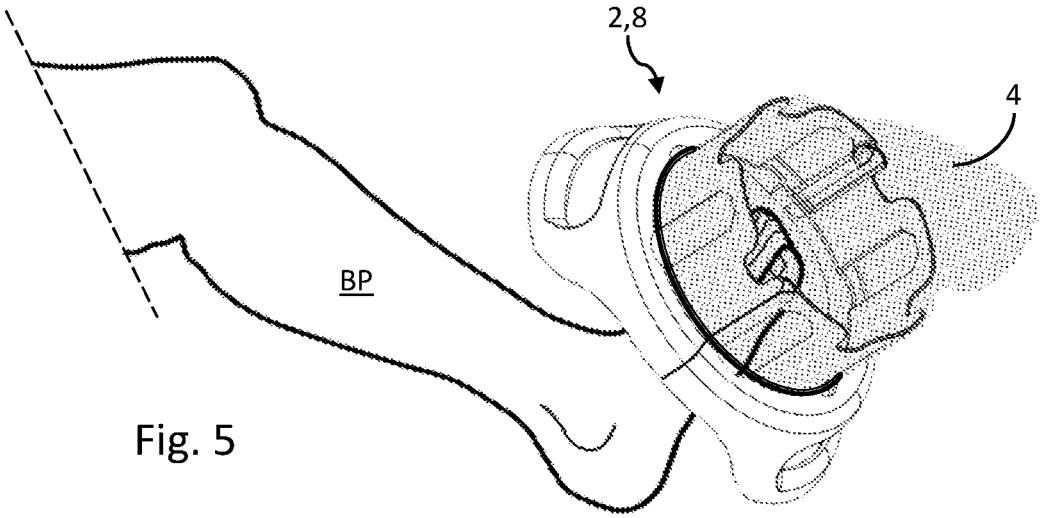
Fig. 5
Fig. 6
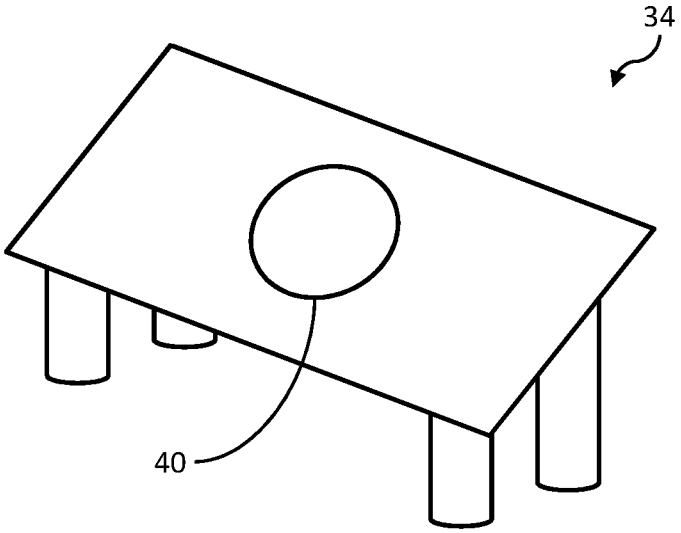

ASSEMBLY, DEVICE, SYSTEM AND METHOD FOR DONNING A COMPRESSIVE GARMENT

CROSS-REFERENCE TO RELATED APPLICATIONS

This application is a U.S. National Stage application under 35 U.S.C. § 371 of International Application PCT/NL2021/050174 (published as WO 2021/221494 A1), filed Mar. 15, 2021 which claims the benefit of priority to Application NL 2025439, filed Apr. 28, 2020. Benefit of the filing date of these prior applications is hereby claimed. Each of these prior applications is hereby incorporated by reference in its entirety.

FIELD

The invention generally concerns an assembly, a device, a system and a method for donning a compressive garment.

BACKGROUND

Compressive garments, also known as compression garments, are known from practice. When worn, compressive garments fit tightly and compress underlying tissue. Such compression can be beneficial in various ways and in various situations. For example, compressive hosiery, in particular compressive stockings, are known for use in the treatment of venous or lymphatic diseases such as deep vein thrombosis.

Due to their tight, compressive fit, the donning of compressive garments is generally difficult, requiring forceful stretching of the garment prior to and during the donning, in order to be able to position the garment appropriately with respect to the relevant body part. In a known method, a user of the garment or an assistant stretches and positions the garment manually. This process is physically demanding, cumbersome, uncomfortable and potentially unsafe.

Efforts have been made to improve the donning of compressive garments. None however have resulted in a satisfactory solution, as evidenced by the fact that manual donning methods are still standard practice, even in relatively affluent settings.

JP2011004875A discloses an auxiliary device for putting on elastic clothes. The device has a pair of divided pieces (half cylindrical bodies) obtained by dividing a tapered hollow cylindrical body (sleeve) whose diameter is made to be gradually smaller toward an end side from a front end side symmetrically around its axis. A mounting device is provided to help stretch the elastic garment towards the auxiliary device by the user operating a drive lever. To subsequently attach the garment to the auxiliary device, the user holds the mouth portion of the elastic garment by hand and pulls down the mouth portion of the elastic garment to the base end of the auxiliary device.

Such manual pulling of a stretched compressive garment is known to require a high degree of strength and dexterity, similar to what is required in a common manual donning method as previously described. Operating such a drive lever requires substantial physical strength as well.

Thus, there remains a need to improve the donning of compressive garments.

SUMMARY

An object of the present invention is to provide improved donning of a compressive garment. An object is to provide a donning method, which requires less user strength and/or less user dexterity. An object is to provide a donning method, which is easier, faster, safer, more efficient, more comfortable and/or more versatile. An object is to at least partially solve at least one of the problems mentioned in the background section.

To that end, an aspect of the present disclosure provides an assembly for donning a compressive garment. The assembly comprises a set of ring sections together forming an openable closed ring structure, which extends around a main ring axis. The ring structure comprises a circumferential wall for receiving a stretched compressive garment thereon. The ring structure is configured for resisting radial compression of the circumferential wall by the received garment. At least two of the ring sections are moveable with respect to each other for opening the ring structure. At least one passage is provided in the circumferential wall of the closed ring structure.

A compressive garment can advantageously be positioned, in particular in a stretched state, onto such a ring structure, whereafter the ring structure with the garment thereon can be moved with respect to, e.g. along, a body part of a user, thereby releasing the garment onto the body part for thus donning the compressive garment. For releasing the ring structure from the body part, the ring structure can be opened, in particular by moving at least two ring sections with respect to each other.

The at least one passage advantageously provides access to the garment through the ring structure in a radially outward direction for moving the garment with respect to the ring structure. The garment can thus be stretched (further) radially outwardly while the garment is at least partly positioned on the ring structure. Such stretching can advantageously reduce friction between the garment and the circumferential wall, easing a further positioning, in particular axial displacement, of the garment with respect to the circumferential wall.

The at least one passage can be particularly versatile, enabling various methods of engaging, e.g. stretching, the compressive garment with respect to the ring structure. Preferably the at least one passage thus provides access for at least one engaging member of a device, in particular, a device as described below for stretching and positioning a compressive garment onto the circumferential wall of the ring structure.

In an embodiment, the at least one passage comprises a plurality passages which are, preferably equally, circumferentially spaced in the circumferential wall of the closed ring structure for allowing compressive garment engaging members of a device for stretching and positioning a compressive garment to extend at least partly radially outwardly through the passages in the circumferential wall for engaging the compressive garment.

In an embodiment, the assembly is configured to be used with a device for stretching and positioning a compressive garment, wherein the device is configured for receiving the ring structure thereon, and for releasing the ring structure therefrom in an axial direction with respect to the main ring axis of the ring structure. In this embodiment, the device may comprise at least one engaging member which is configured for engaging at least part of the compressive garment and for moving at least the engaged part of the garment with respect to the circumferential wall of the assembly. Thereby, the at least one engaging member is moveable between a radially retracted position and a radially extended position and the at least one passage which is provided in the circumferential wall of the closed ring structure is arranged and configured such that, in the extended position, the engaging member at least partly extends radially outwardly through the at least one passage of the circumferential wall. In the retracted position the engaging member extends less or not through the passage.

A further aspect of the present disclosure provides a device for stretching and positioning a compressive garment onto the circumferential wall of the ring structure of the above-described assembly for donning a compressive garment. The device is configured for receiving the ring structure thereon, and for releasing the ring structure therefrom in an axial direction with respect to the main ring axis of the ring structure.

The device comprises at least one engaging member which is configured for engaging at least part of the compressive garment and for moving at least the engaged part of the garment with respect to the circumferential wall.

The at least one engaging member is moveable between a radially retracted position and a radially extended position. In the extended position the engaging member at least partly extends radially outwardly through the at least one passage of the circumferential wall. In the retracted position the engaging member extends less or not through the passage.

Such a device can greatly reduce the manual effort and dexterity required to position a compressive garment onto the ring structure. In the extended position, the at least one engaging member can advantageously engage the garment, in particular in the area of the at least one passage. The at least one engaging member can thus engage the garment preferably both radially outwardly, thus reducing friction between garment and ring structure, and axially, thus positioning the garment further onto the ring structure.

In the retracted position, the ring structure with the stretched garment thereon can easily be removed from the device for subsequent donning of the garment.

A further aspect provides an auxiliary positioning device. The auxiliary positioning device comprises a ring body extending around a central axis of the auxiliary positioning device for receiving an at least partially rolled up compressive garment in a substantially non-stretched configuration. The auxiliary positioning device further comprises a plurality of circumferentially distributed fingers extending substantially axially from said ring body, said fingers being radially inwardly biased to a radially inwardly moved position and configured to be moveable radially outwardly to a radially outwardly moved position when a radially outwardly directed force component is exerted on the respective fingers.

With such an auxiliary positioning device, a compressive garment can be easily applied onto the device and subsequently on the assembly of the system. First, the compressive garment is positioned in a non-stretched condition on the auxiliary positioning device. Subsequently, by pushing the auxiliary positioning device on the axial end of the device, transfer of the compressive garment from the auxiliary positioning device to the device of the present disclosure and subsequently to the assembly of the present disclosure is made very easy and reliable for the user.

A further aspect provides a system for donning a compressive garment, the system comprising the assembly and the device as described above.

Such a system can provide the above-mentioned advantages, thereby enabling a particularly advantageous method of donning a compressive garment as described below.

A further aspect provides a method of donning a compressive garment. The method comprises: providing the above—described system for donning a compressive garment; receiving, on the device, the closed ring structure formed by the set of ring sections of the assembly; engaging at least part of the compressive garment with the at least one engaging member of the device; and stretching, by the device, at least part of the compressive garment radially outwardly with respect to the main ring axis.

Such a method can provide the above-mentioned advantages, wherein a compressive garment can be donned easily, in particular without requiring a high degree of strength and dexterity.

Further advantageous elaborations of the invention are provided by the features of the dependent claims, as will be explained further in the detailed description.

DETAILED DESCRIPTION

In the following, the invention will be explained further using exemplary embodiments and drawings. The drawings are schematic and merely show examples. In the drawings, similar or corresponding elements have been provided with similar or corresponding reference signs. In the drawings:

FIGS. 1*a* and 3*a* each show an isometric view of a system for donning a compressive garment according to an embodiment, the system comprising a respective device and a respective assembly, wherein in FIG. 1*a* the system is provided with a compressive garment;

FIG. 1*b* shows an isometric view of the assembly of the system of FIG. 1*a*, wherein respective ring sections form a ring structure and wherein a compressive garment is positioned on the ring structure;

FIGS. 2*a-c* each show an isometric view of the assembly of FIG. 1*b*, wherein the respective ring sections are in different relative positions;

FIG. 3*b* shows a top view of the device of the system of FIG. 3*a;*

FIGS. 4*a-b* each show a partially opened isometric view of the device of FIG. 3*b;*

FIG. 5 illustrates an exemplary method of donning a compressive garment;

FIG. 6 shows an isometric view of an exemplary support structure;

Figure 9A:
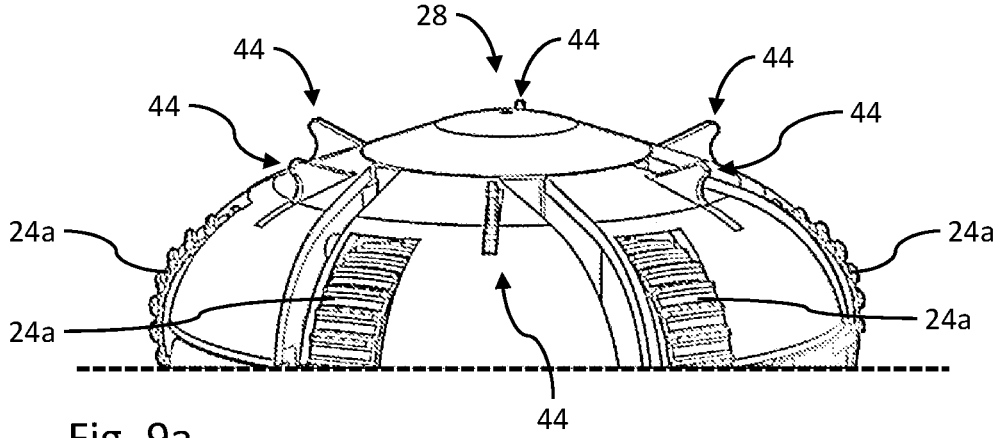
Figure 9B:
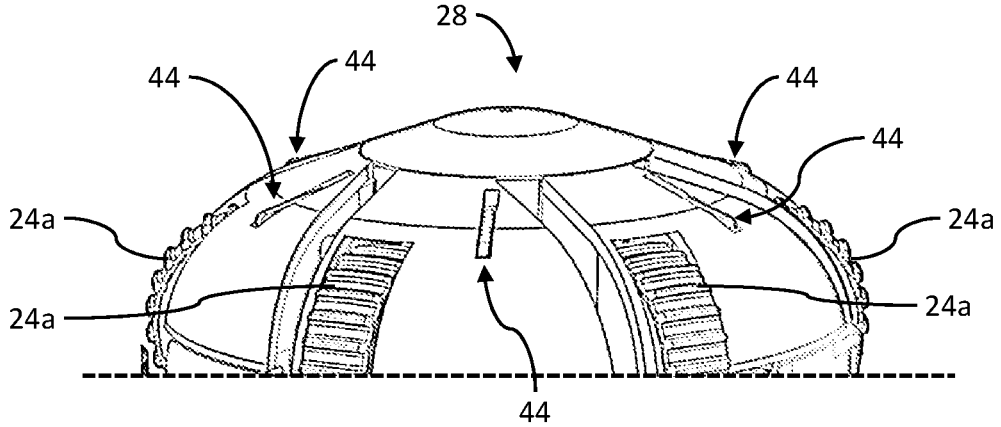
Figure 10:
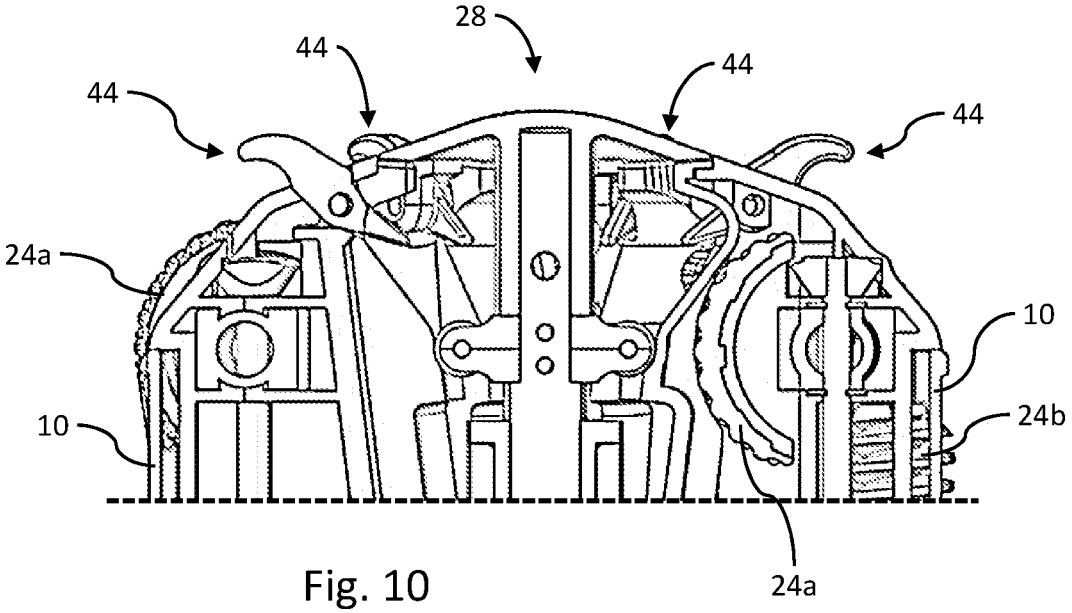
Figure 13:
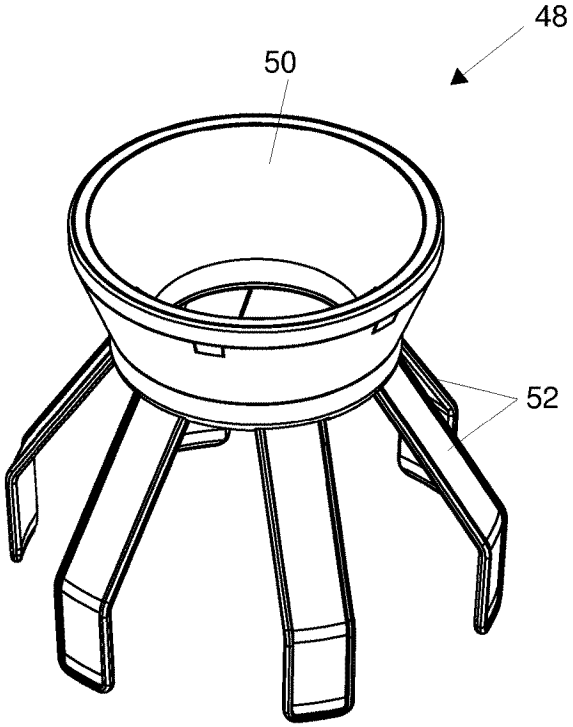
Figure 11:
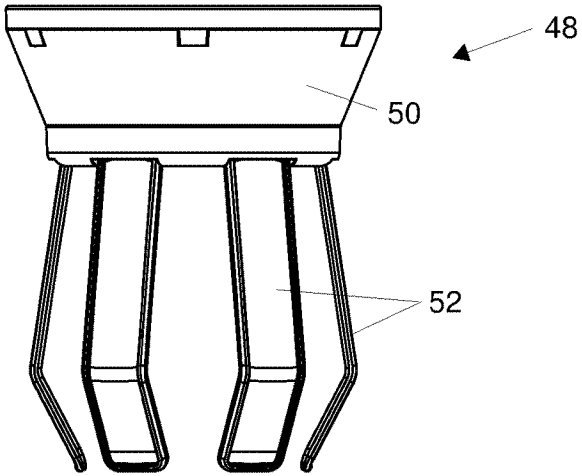
Figure 12:
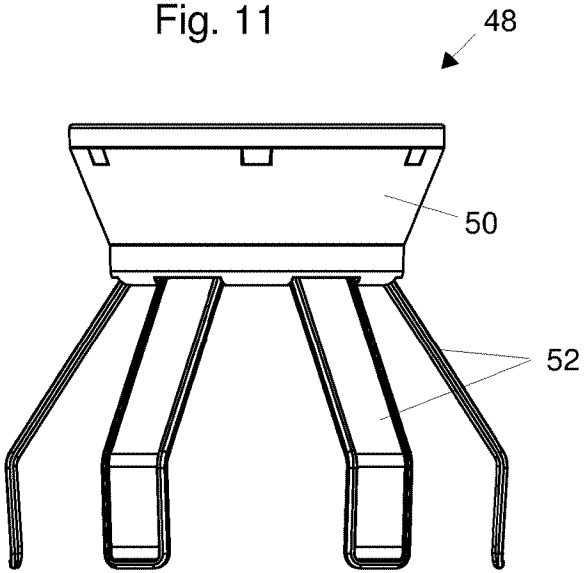
Figure 14:
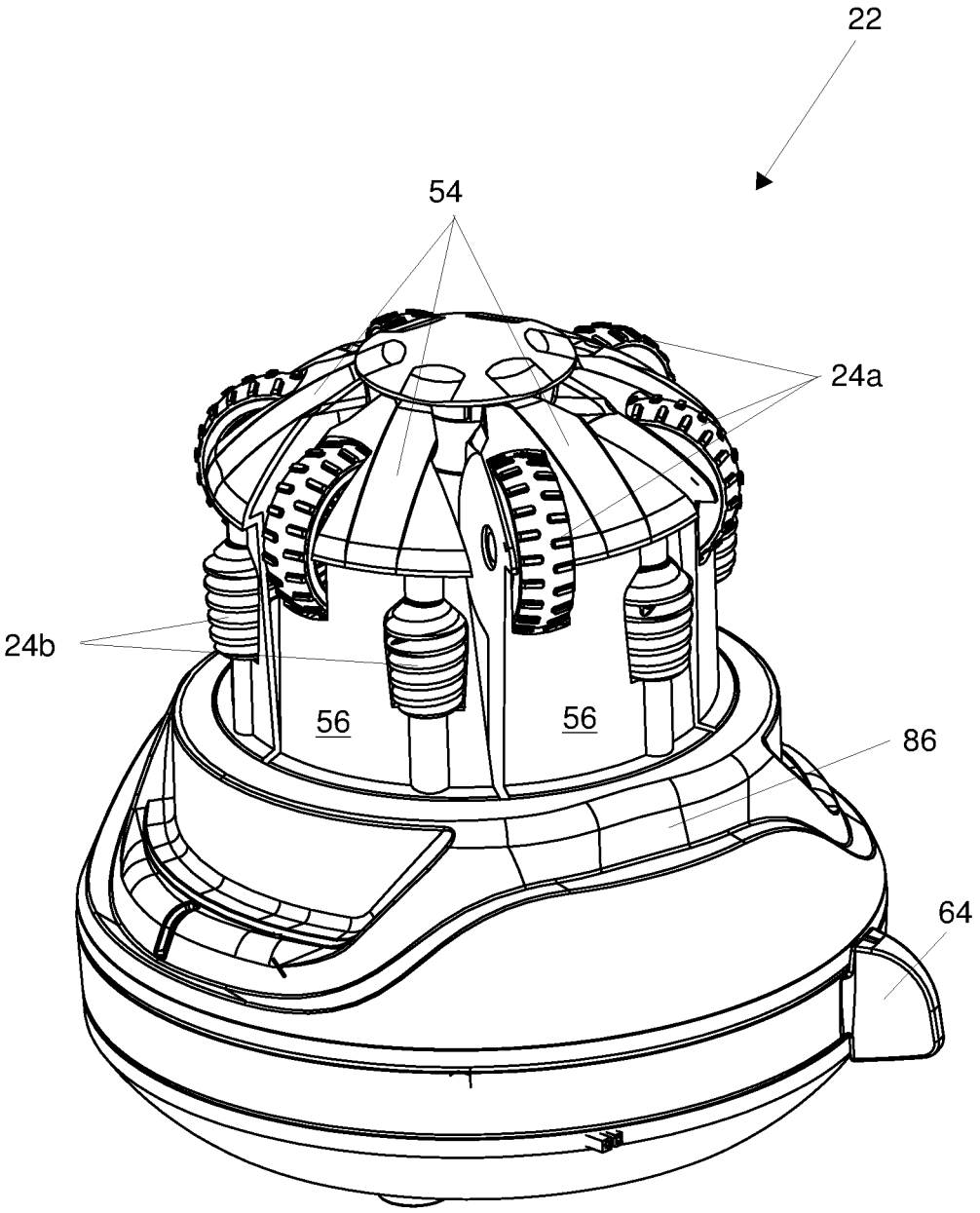
Figure 15:
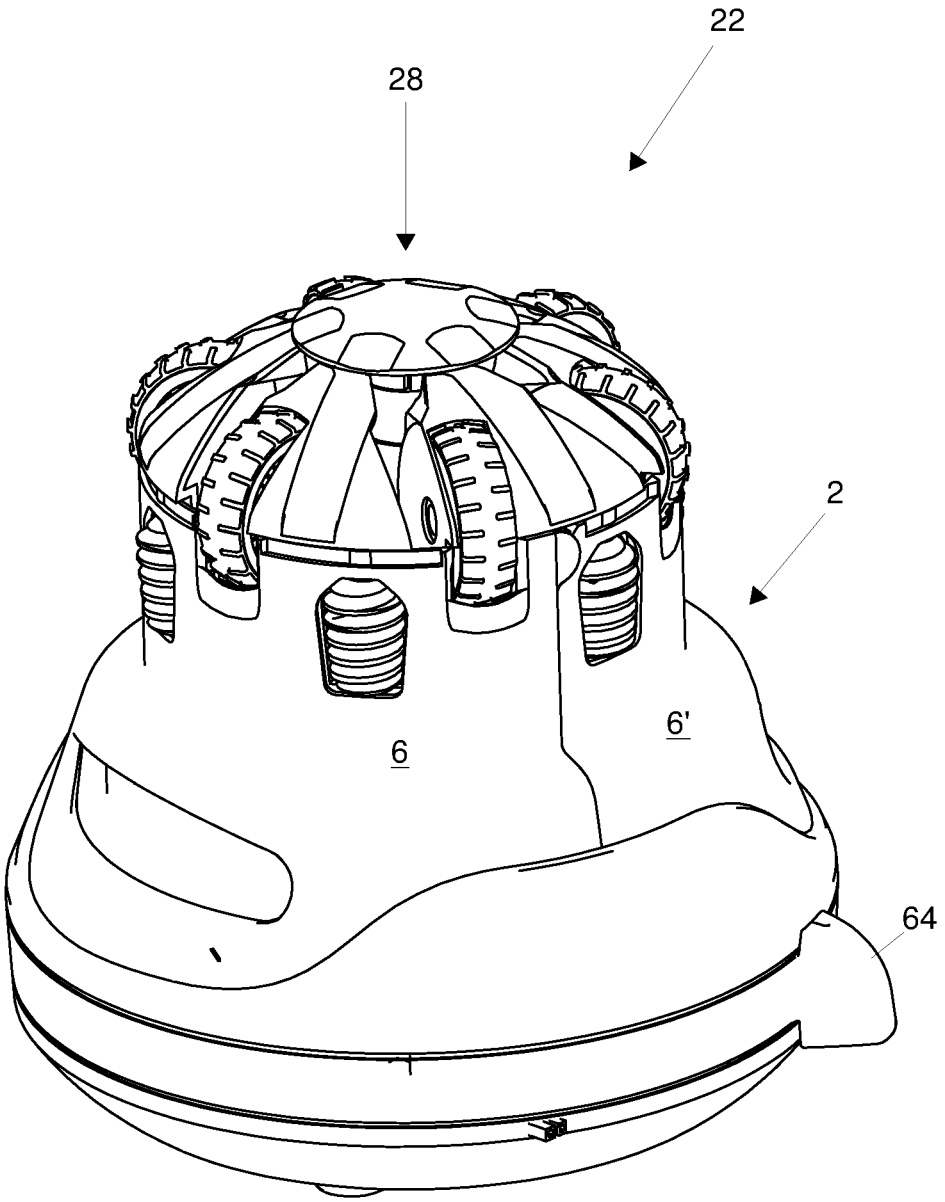
Figure 16:
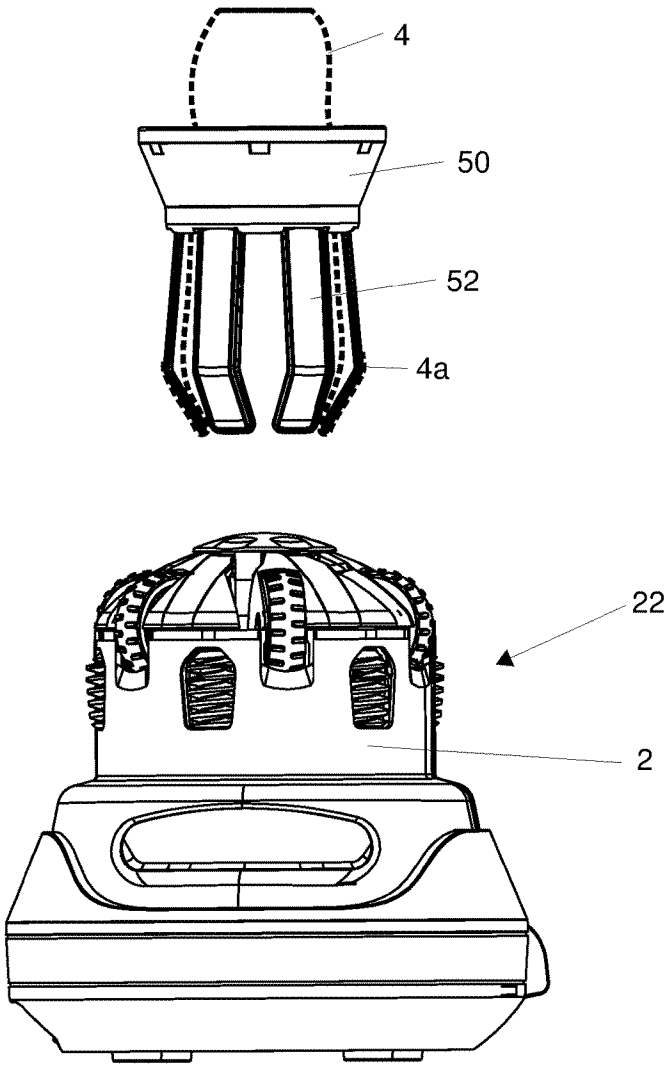
Figure 17:
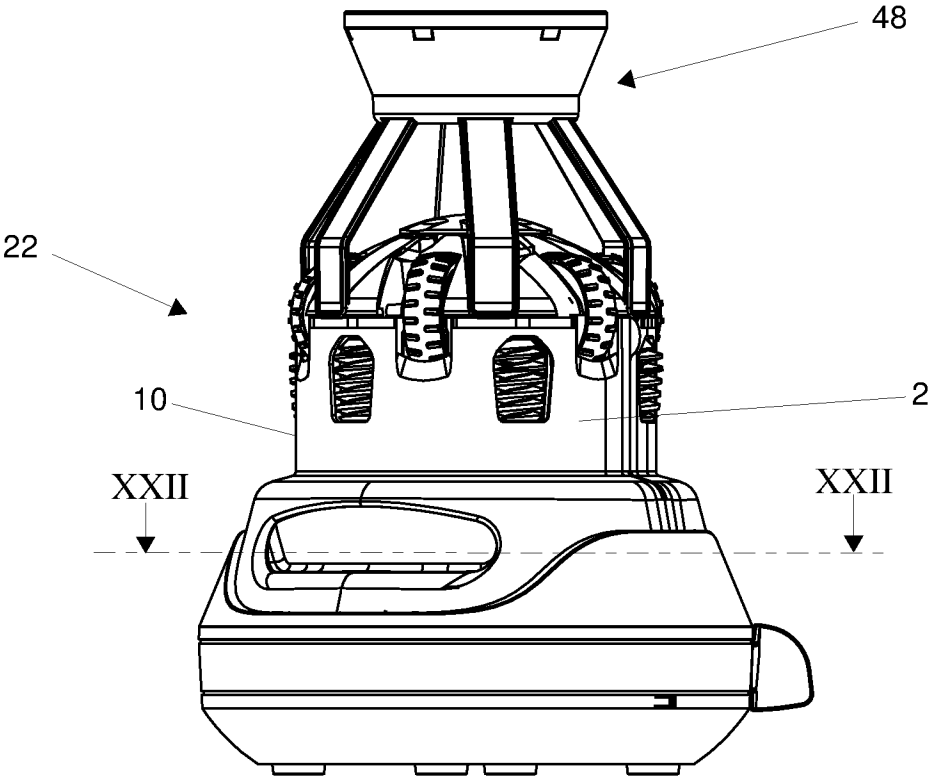
Figure 18:
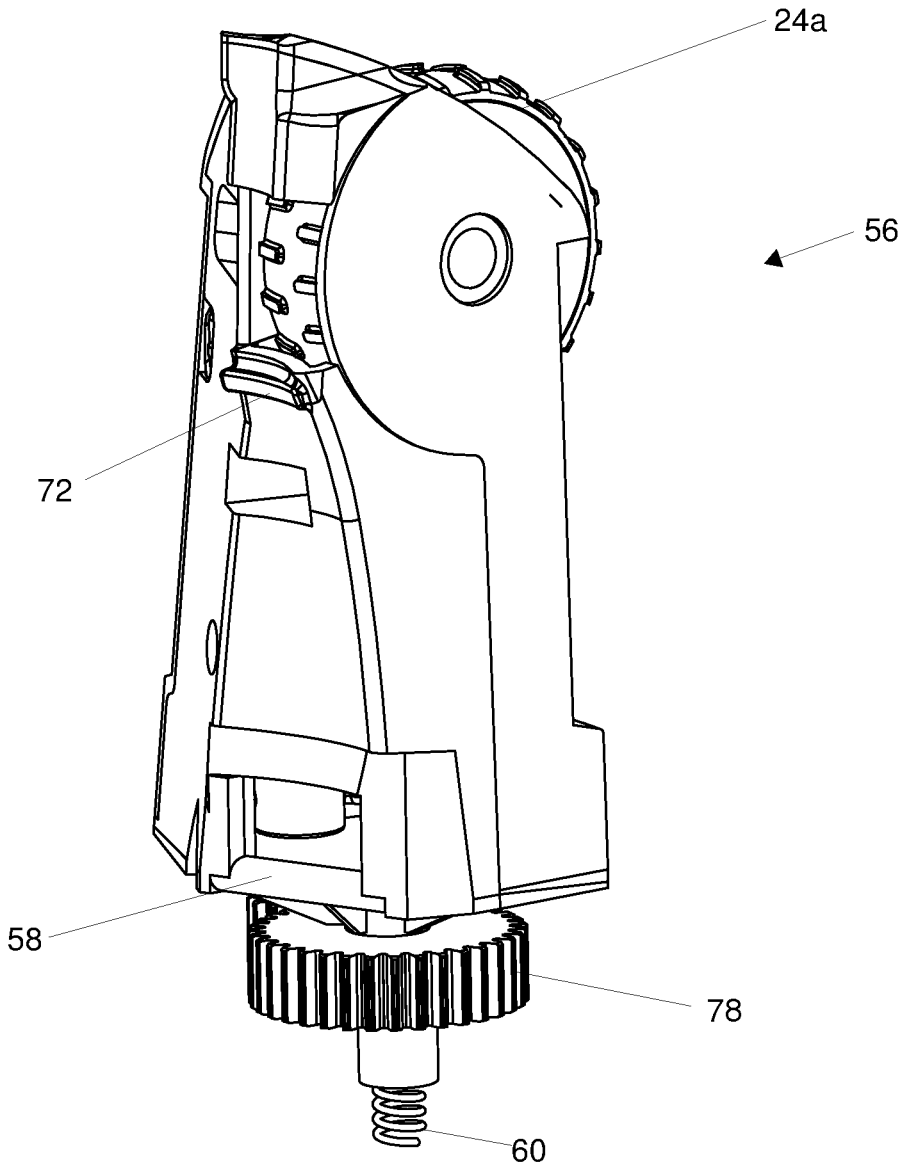
Figure 19:
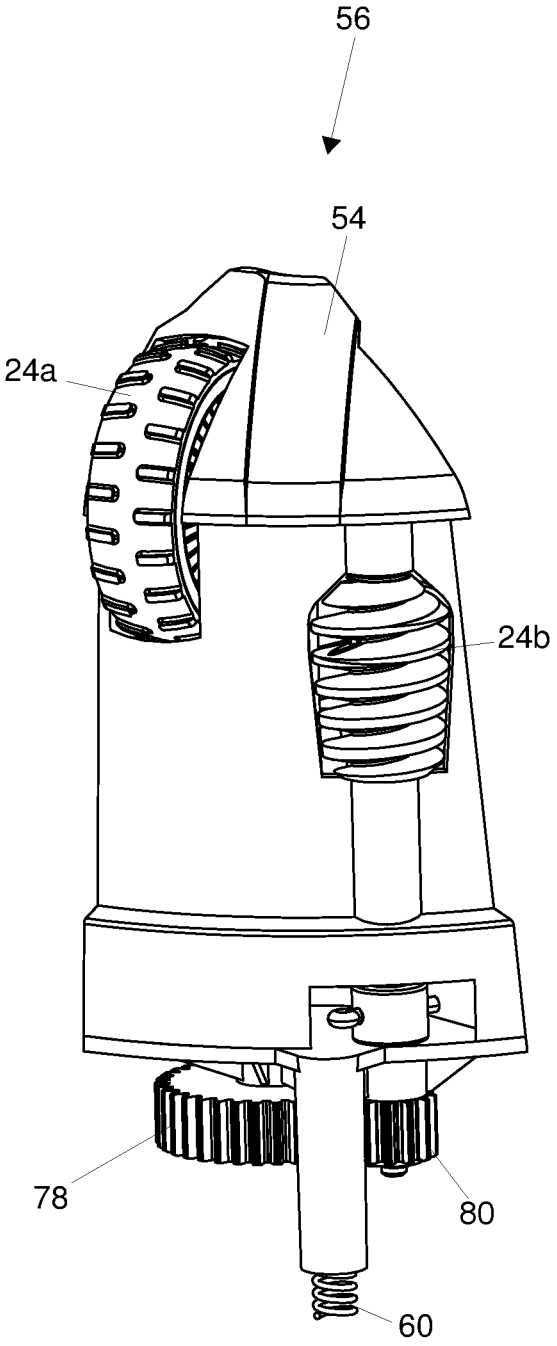
Figure 20:
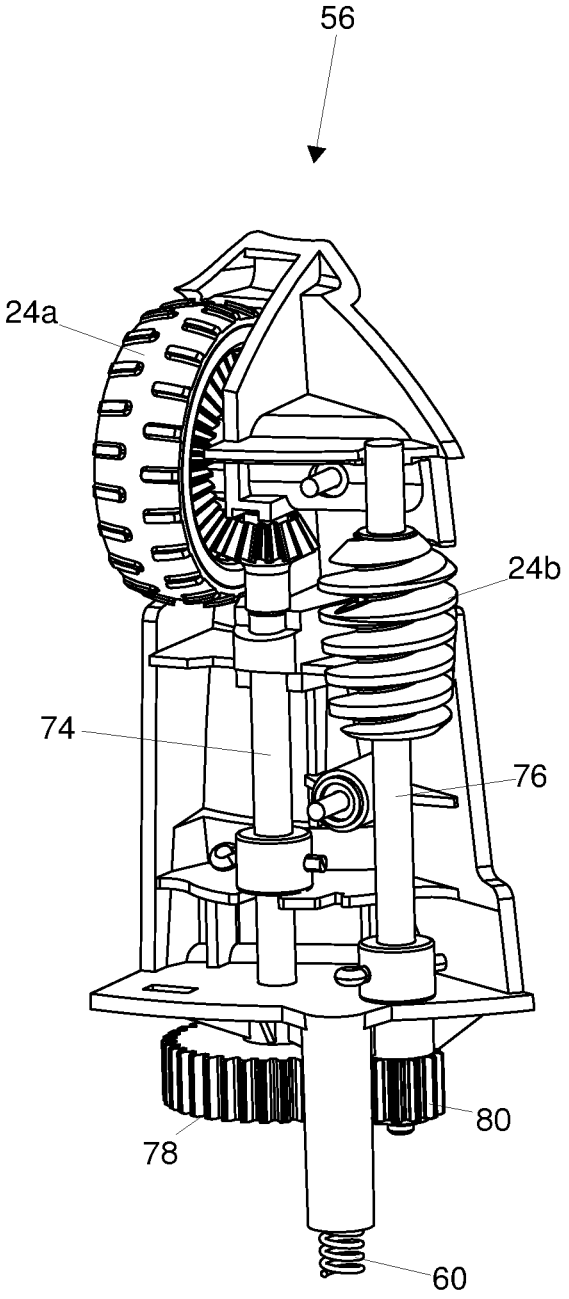
Figure 21:
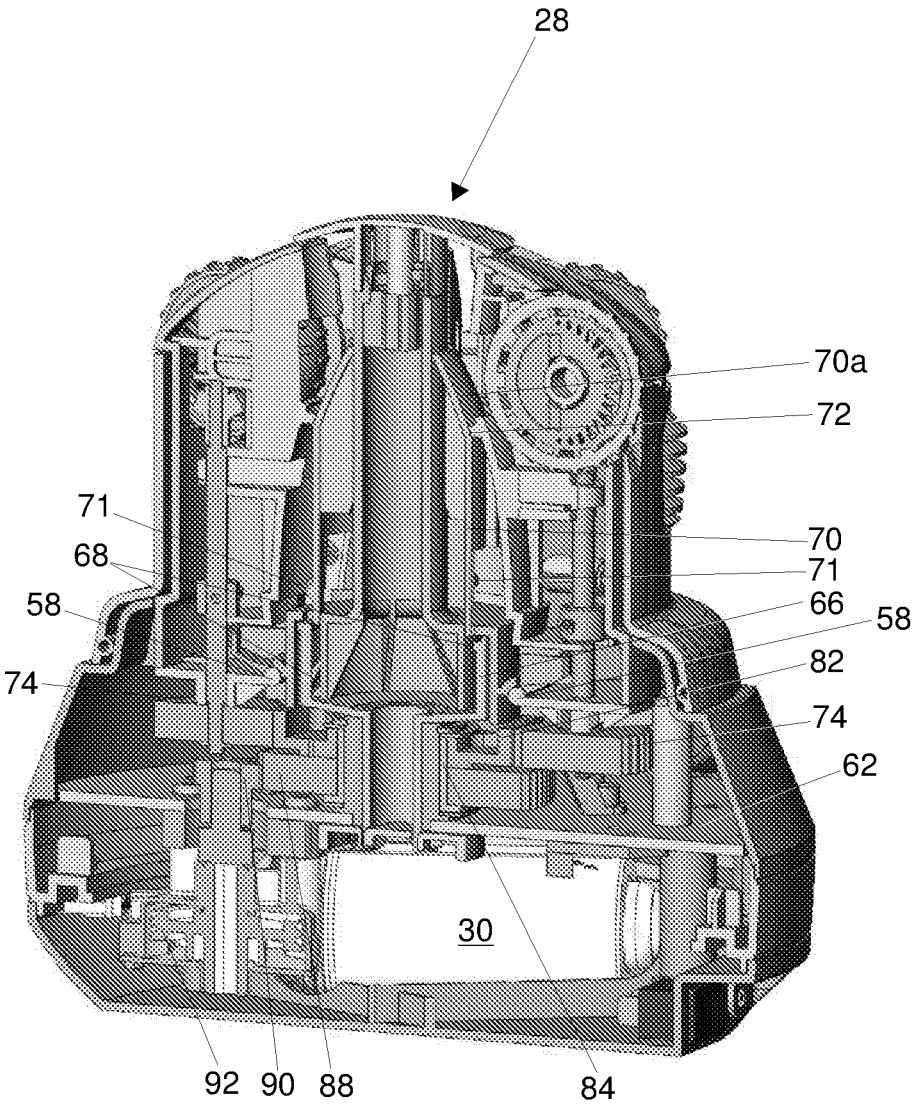
Figure 22:
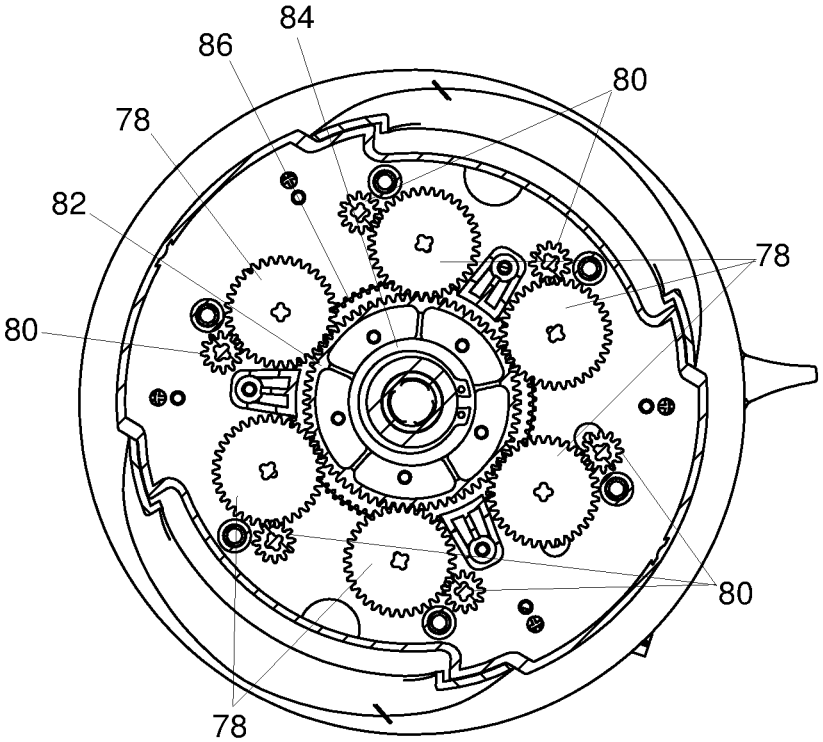

FIGS. 9*a-b* each show an isometric view of a top part of a device according to a further embodiment;

FIG. 10 shows a partially opened isometric view of a top part of a device according to a further embodiment;

FIGS. 11-13 show an example of an auxiliary positioning device;

FIG. 14 shows a second example of a device without the assembly for donning a garment placed thereon;

FIG. 15 shows the second example of the device of FIG. 14 with the assembly for donning a garment placed thereon;

FIG. 16 shows a side view of the device of FIGS. 14 and 15 and above the device the auxiliary positioning device of FIGS. 11-13 with a compressive garment placed thereon;

FIG. 17 shows a similar side view as shown in FIG. 16 with the auxiliary positioning device being pushed onto the axial end of the device, whereby the garment is not shown to improve clarity;

FIGS. 18-20 show a segment of the device from various view points, whereby in FIG. 20 a wall part has been removed to show the interior of the segment;

FIG. 21 shows a perspective cross-section view of the device shown in FIGS. 14-17; and FIG. 22 shows the cross-section over cross section line XXIII-XXIII in FIG. 17.

Figure 1A:
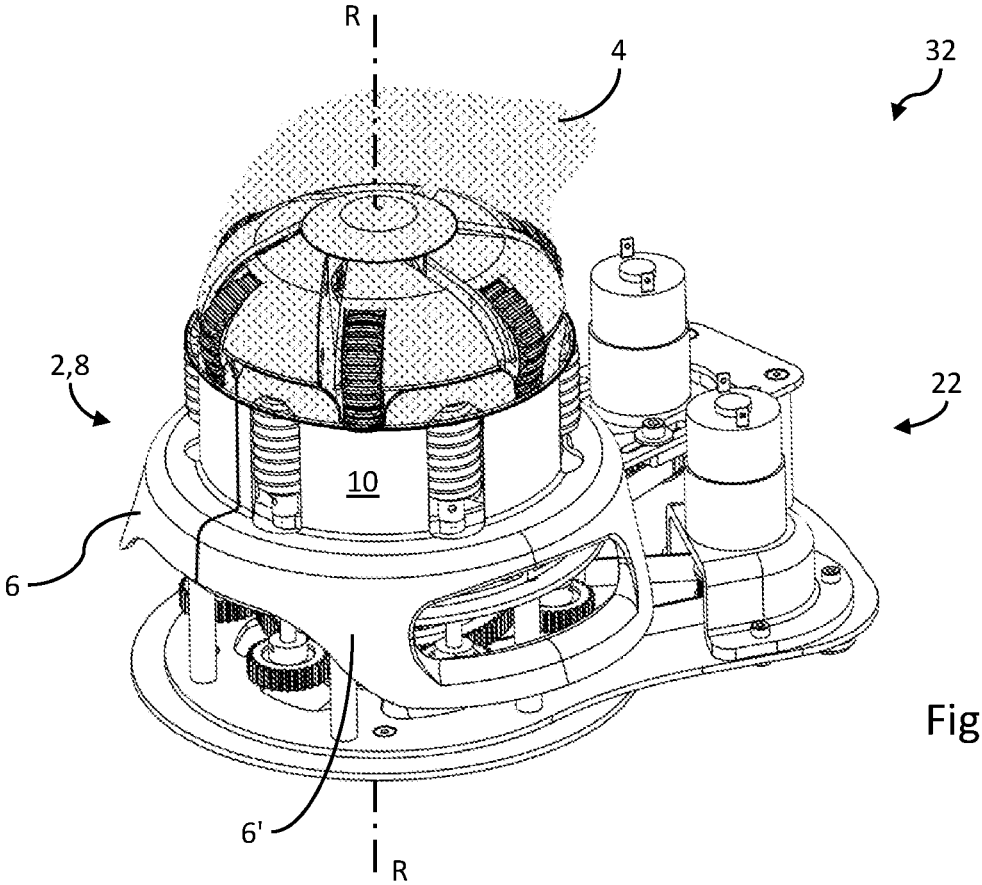
Figure 1B:
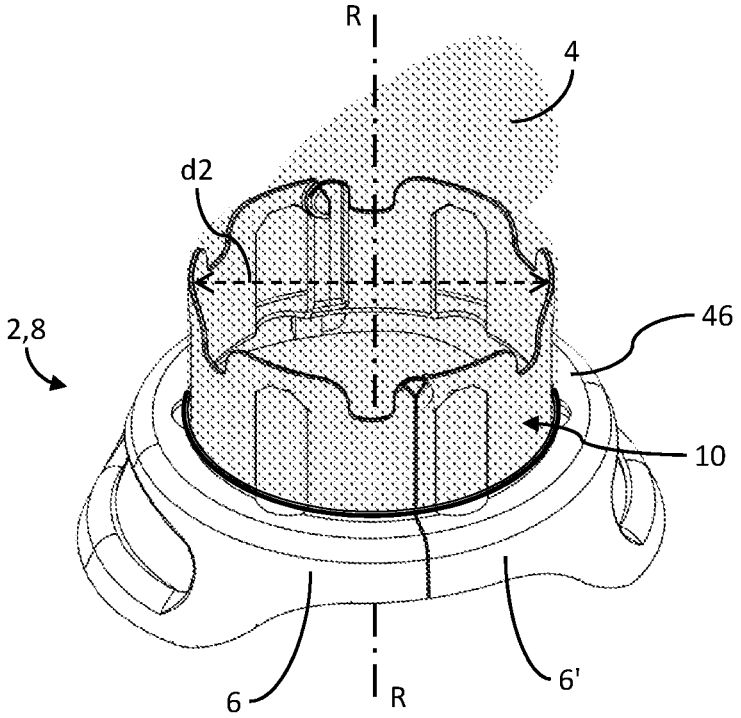

FIGS. 1*b* and 2*a-c* show an assembly 2 for donning a compressive garment 4. FIGS. 1*a* and 3*a* show such an assembly 2 as part of a system 32 for donning a compressive garment, wherein the assembly 2 is positioned to cooperate with a device 22 of the system 32. FIG. 5 shows such an assembly 2 in an illustration of an exemplary method of donning a compressive garment. A compressive garment 4 positioned on the assembly 2 can be seen in FIGS. 1*b* and 5.

The assembly 2 comprises a set of ring sections 6, 6' together forming an openable closed ring structure 8 (see FIGS. 1*b*, 2*b*) which extends around a main ring axis R. The ring structure 8 comprises a circumferential wall 10 for receiving a stretched compressive garment 4 thereon (see FIG. 1*b*).

In the context of the present disclosure, a ring structure can be in the form of a hollow substantially cylindrical and/or frusto-conical structure. However, no part of the ring structure needs to be strictly cylindrical or conical or circular. A ring structure can have one or more non-curved, e.g. flat and/or angular, sections. In the present context, a closed ring structure provides a substantially continuous structure along the entire circumference of the ring, thus without any circumferential end. However, such a continuous structure need not be continuous in any one plane. Among other options, a closed ring structure can thus comprise a structure, which meanders and/or zigzags with respect to the ring's axial and/or radial direction while providing a structurally continuous circumferential path.

The ring structure 8 is configured for resisting radial compression of the circumferential wall 10 by the received garment 4. Such a compression resistive configuration can be realized in various ways. For example, the ring structure 8 or part thereof can be made from a substantially stiff material, for example, a hard plastic. As another example, the circumferential wall 10 can be provided with one or more flanges, ribs and/or similar reinforcement structures, e.g. extending circumferentially. Such a flange 46 has been indicated in FIG. 1*b*.

Figure 2A:
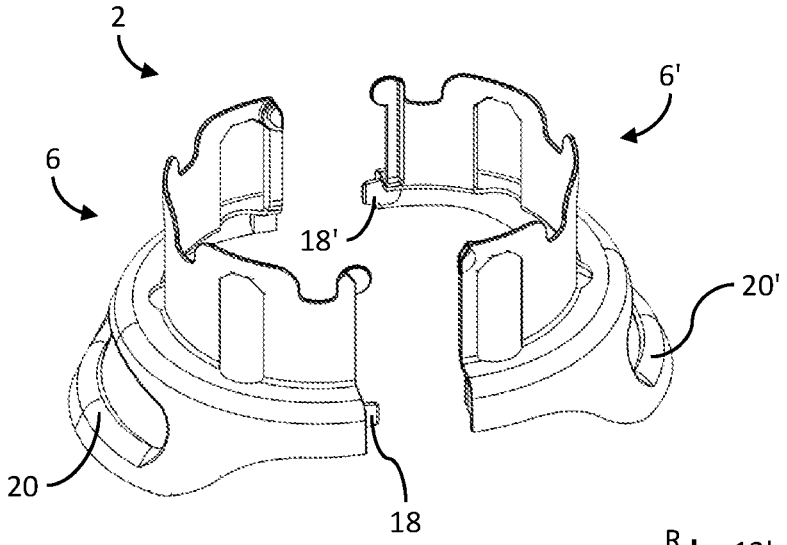
Figure 2B:
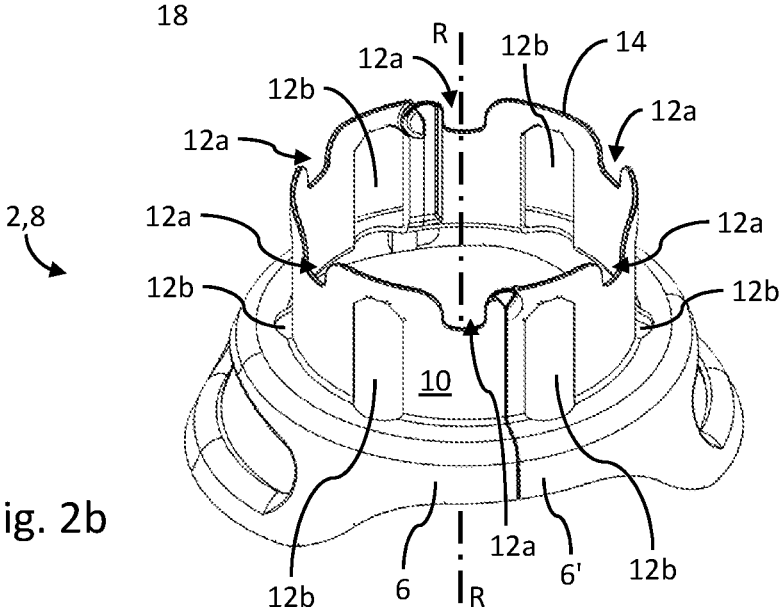
Figure 2C:
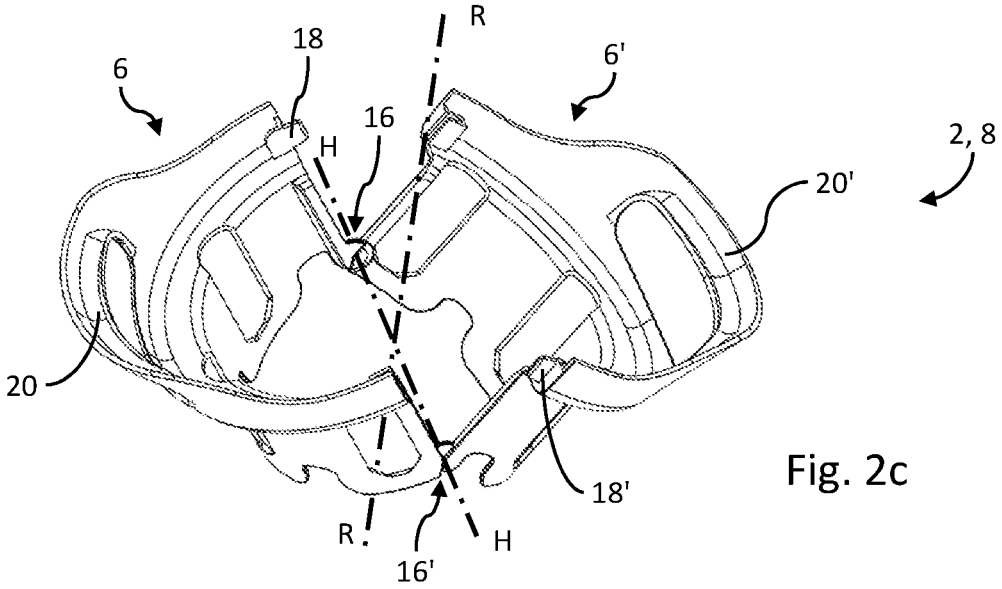
Figure 3A:
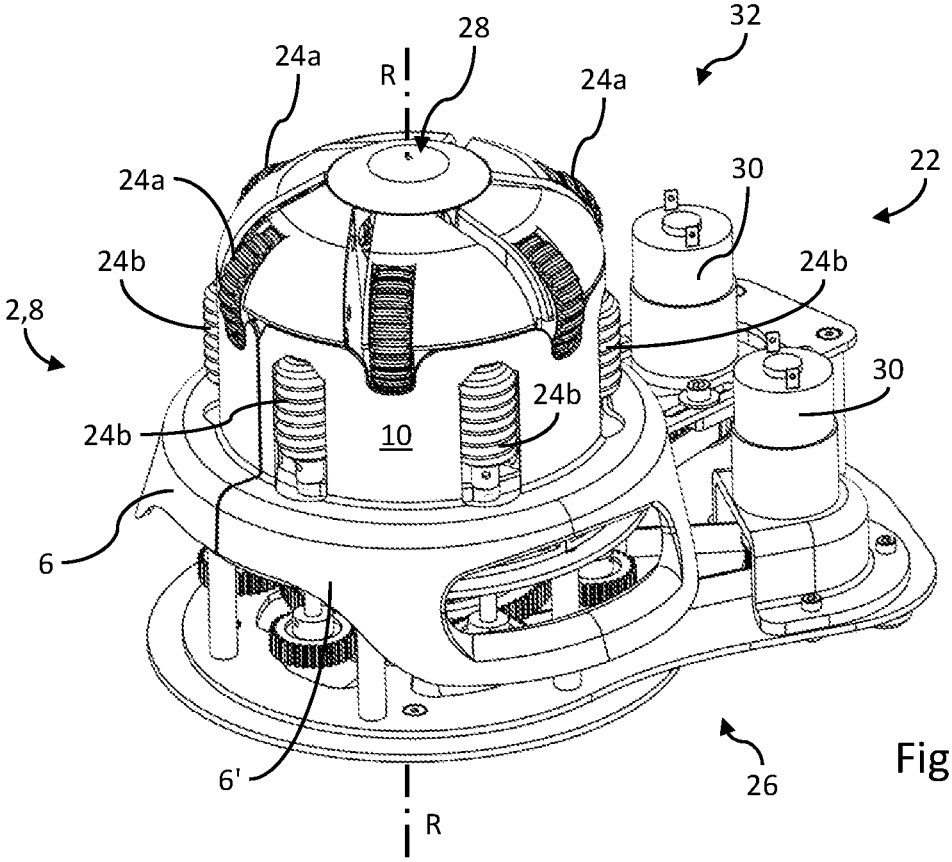
Figure 3B:
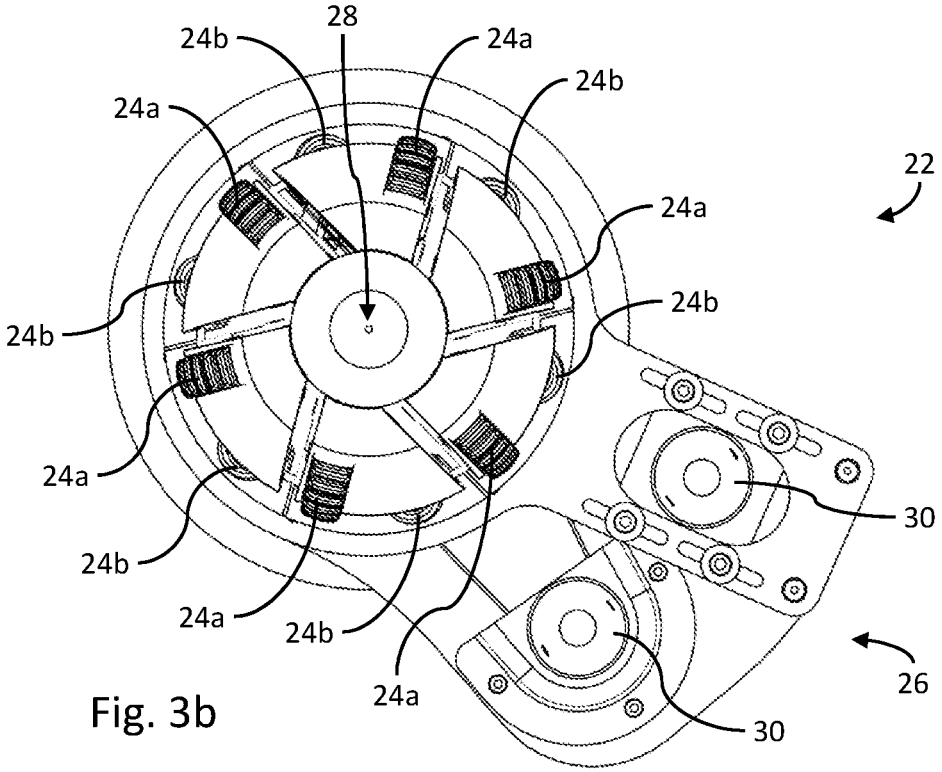

As shown e.g. in FIGS. 2*a* and 2*c*, at least two of the ring sections 6, 6' are moveable with respect to each other for opening the ring structure 8. Such movability can involve rotatability and/or translatability.

At least one passage 12*a*, 12*b* (see FIG. 2*b*) is provided in the circumferential wall 10 of the closed ring structure 8. Such a passage 12*a*, 12*b* can be realized in various ways, examples of which are provided below.

In an embodiment, the at least one passage 12*a*, 12*b* comprises at least one first passage 12*a* defined by an axial indentation in an axial edge 14 of the circumferential wall 10.

Such a first passage 12*a* advantageously enables actuation, in particular radially outward actuation, of the garment 4 in the area of the axial edge 14, in particular for positioning the garment 4 or part thereof axially onto the circumferential wall 10 from a position at a distance therefrom.

In an embodiment, the at least one passage 12*a*, 12*b* comprises at least one second passage 12*b* defined by an opening through the circumferential wall 10.

Such a second passage 12*b* advantageously enables actuation, in particular radially outward actuation, of the garment 4 along the circumferential wall 10, i.e. between different positions along the wall 10, for example for distributing the garment 4 or part thereof across the axial length of the circumferential wall 10.

In an embodiment, see e.g. FIG. 2*b*, the at least one first passage 12*a* is separate from the at least one second passage 12*b*, wherein in axial direction the at least one first passage 12*a* at least partially overlaps with the at least one second passage 12*b*.

Such a configuration enables a closed ring structure 8 to be formed by the circumferential wall 10 while enabling garment actuation substantially along the axial length of the circumferential wall 10.

In an embodiment, the at least one first passage 12*a* comprises a plurality of first passages 12*a*, wherein the at least one second passage 12*b* comprises a plurality of second passages 12*b*, wherein the first and second passages 12*a*, 12*b* are arranged alternatingly along the circumferential direction of the ring structure 8.

Such a configuration enables a substantially homogeneous actuation of the garment 4 along the circumferential wall 8.

In an embodiment, the ring structure 8 comprises one or more hinges 16, 16' for hinging two or more of the ring sections 6, 6' with respect to each other, wherein the two or more ring sections 6, 6' are separable from each other at the hinges 16, 16' for opening the ring structure 8.

Such hinges 16, 16' have been indicated in FIG. 2*c*. FIG. 2*a* shows the ring sections 6, 6' separate from each other, thus opening the ring structure 8. A suitable hinge 16, 16' can be realized in various ways, for example, as shown, by a rounded tongue and groove structure. To facilitate easy positioning of the tongue in the groove, the groove can be provided with one or more guiding walls which extend from a side of the groove to guide the tongue towards the groove.

In an embodiment, with reference to FIG. 2*c*, the one or more hinges 16, 16' define at least one hinging axis H which extends at an angle to the main ring axis R, such that the ring structure 8 can be changed between a first shape and a second shape by hinging the two or more ring sections 6, 6' about the at least one hinging axis H, wherein, compared to the first shape, the second shape is more tapered along the main ring axis R.

Such a configuration enables easier release of the garment 4 from the ring structure 8, in particular during and/or after donning the garment 4, wherein such release subsequently enables opening of the ring structure 8 as shown in FIG. 2*a*.

In an embodiment, at least one of the ring sections 6, 6' is provided with one or more connectors, for example cams 18, 18' and/or magnets, for interfacing with another one of the ring sections 6, 6' for resisting relative movement thereof in at least one of a radial direction and an axial direction.

Such a configuration enables the formation of a robust openable ring structure 8 which in particular resists radial compression. The cams 18, 18' may provide a snap connection, for example. It should be noted that the connectors shown as cams 18, 18' in FIG. 2*c* do not have to be positioned at the upper edge of the ring sections 6, 6' but may also be positioned closer to the hinges 16, 16'. This may help to prevent inadvertent parting of the ring sections 6, 6' by inadvertent hinging around the connectors 18, 18', e.g. when an upwardly directed force is exerted on the handles 20, 20'.

In an embodiment, at least two of the ring sections 6, 6' are each provided with a respective handle 20, 20' for moving the ring sections 6, 6' with respect to each other, wherein the handles 20, 20' are radially and axially spaced apart from the circumferential wall 10. Preferably, the handles 20, 20' are distributed substantially evenly along the circumference of the ring structure 8.

Such handles enable easy handling of the assembly, for example for forming, positioning, hinging and/or opening the ring structure 8.

Figure 8:
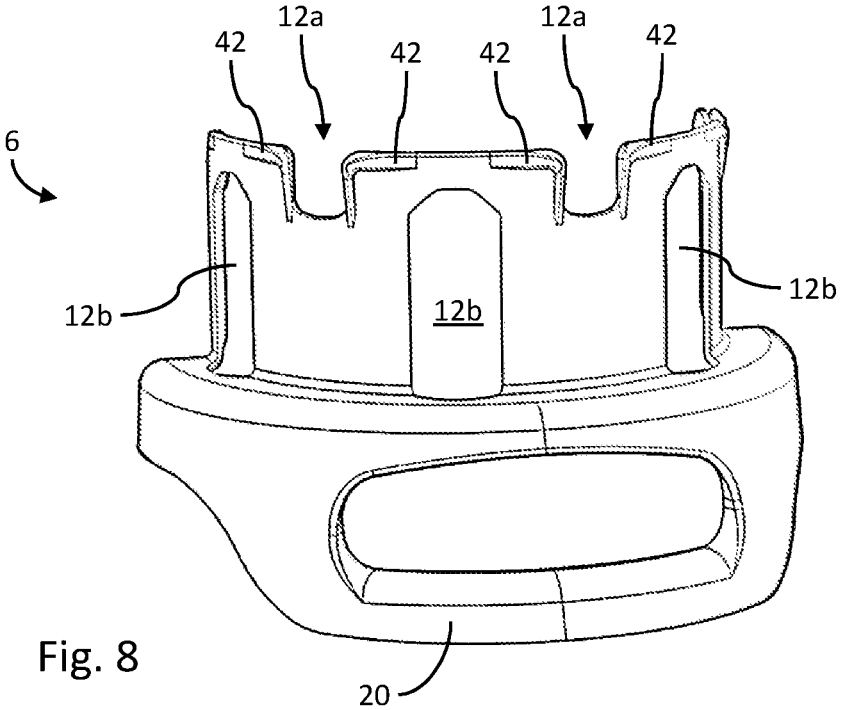
FIG. 8 shows a ring section according to a further embodiment.

FIG. 8 shows an advantageous optional elaboration of the ring section 6 (equally applicable to ring section 6'). In this example, each of the first passages 12*a* is provided with one or more respective spacing structures 42 which extend radially outwardly from at least an axially open end of the first passage 12*a*.

Such spacing structures 42 can advantageously help prevent that part of the garment 4 is inadvertently moved radially inwardly of the circumferential wall 10, thereby getting stuck in between the ring structure 8 and the device 22.

Optionally, the edge of the circumferential wall 10 of the ring structure 8 of the assembly 2 may have a structure, which has a higher friction coefficient relative to the friction coefficient of the outer surface of the circumferential wall 10. This may prevent that the compressive garment 4 slips off the circumferential wall 10 during the transfer of the compressive garment 4 onto the circumferential wall 10. The higher friction coefficient may, for example, be achieved by a roughened local surface structure or by an added layer of material at the edge, e.g. an edge provided with a silicone layer.

FIGS. 3*b*, 4*a-b*, 9*a-b*, and 10 show examples of at least part of a device 22 for stretching and positioning a compressive garment 4 onto the circumferential wall 10 of the ring structure 8 of the assembly 2. FIGS. 1*a* and 3*a* show such a device 22 as part of the system 32.

The device 22 is configured for receiving the ring structure 8 thereon, and for releasing the ring structure 8 therefrom in an axial direction with respect to the main ring axis R of the ring structure 8.

The device 22 comprises at least one engaging member 24*a*, 24*b* (see e.g. FIGS. 3*a-b*) which is configured for engaging at least part of the compressive garment 4 and for moving at least the engaged part of the garment 4 with respect to the circumferential wall 10.

The at least one engaging member 24*a*, 24*b* is moveable between a radially retracted position and a radially extended position, wherein in the extended position the engaging member 24*a*, 24*b* at least partly extends radially outwardly through the at least one passage 12*a*, 12*b* of the circumferential wall 10 (FIG. 3*a*), wherein in the retracted position the engaging member 24*a*, 24*b* extends less or not through the passage 12*a*, 12*b*.

Figure 4A:
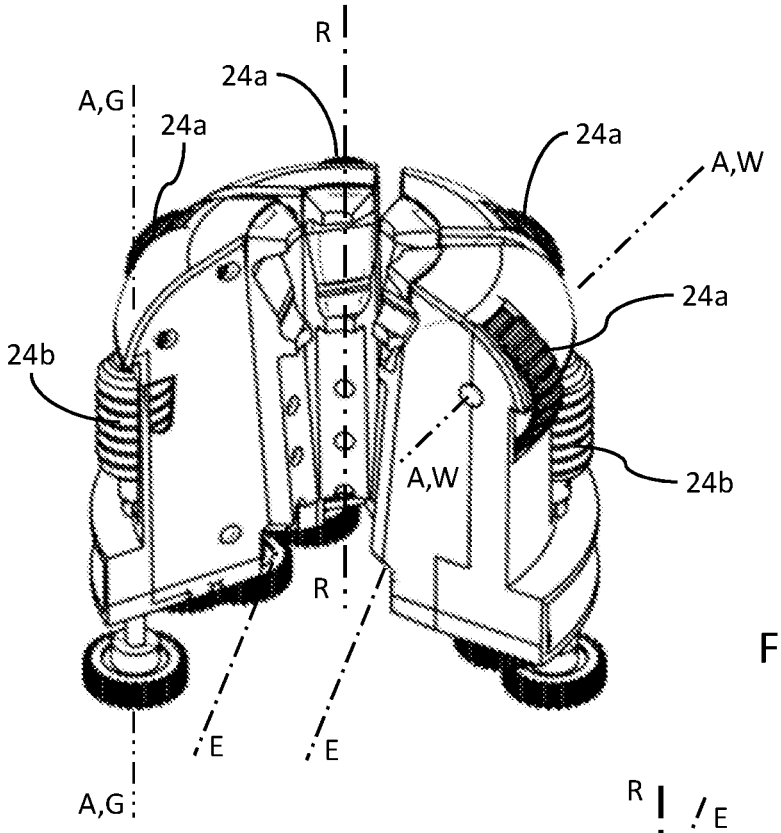
Figure 4B:
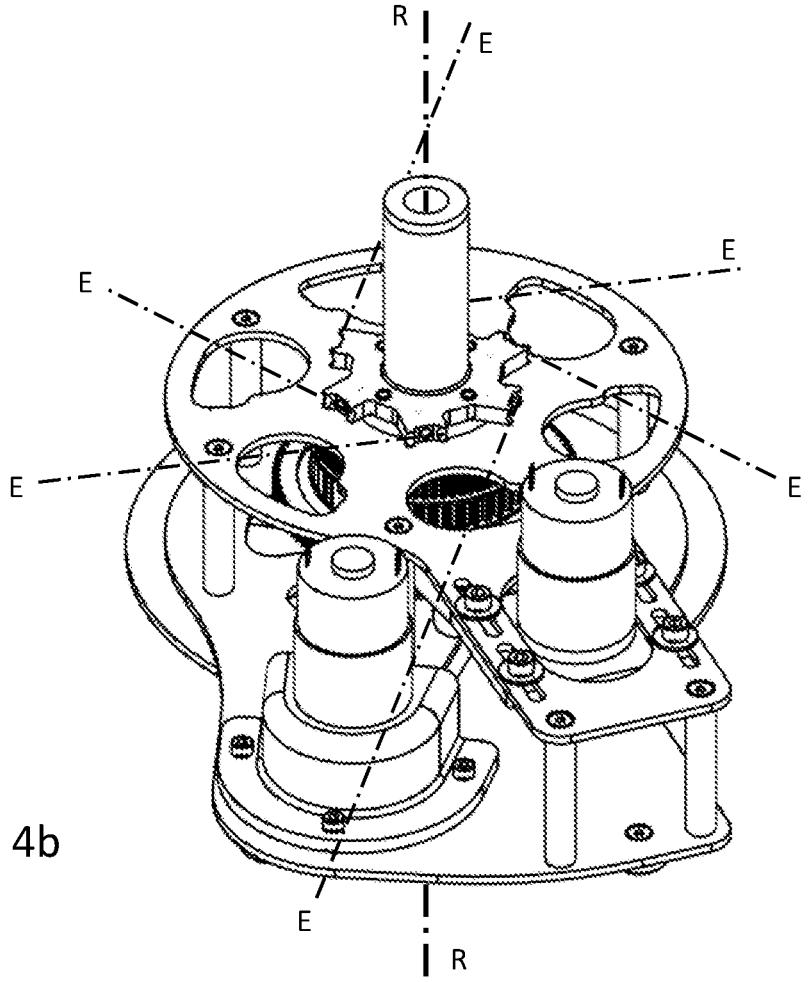

The drawings show the at least one engaging member 24*a*, 24*b* in the radially extended position. With reference to FIGS. 4*a-b*, the at least one engaging member 24*a*, 24*b* can in this example be moved to the radially retracted position by a rotation of respective device parts about respective extension axes E. It can be seen that the at least one engaging member 24*a*, 24*b* can thus be moved radially inward with respect to the main ring axis R. From the radially retracted position, the at least one engaging member 24*a*, 24*b* can be moved back to the radially extended position by a reverse rotation about the extension axes E. It will be appreciated that many alternative configurations are possible to enable the movability between the extended and retracted positions. In some alternatives, respective device parts may be translated rather than rotated. In some alternatives, a combination of translation and rotation can be provided.

In an embodiment, with reference to FIG. 4*a*, the at least one engaging member 24*a*, 24*b* is rotatably drivable about a respective engaging member axis A, the axis A being radially moveable with respect to the main ring axis R between a first position in which the respective engaging member 24*a*, 24*b* is in the retracted position and a second position in which the respective engaging member 24*a*, 24*b* is in the extended position.

The at least one engaging member 24*a*, 24*b* can thus be moved between the extended position and the retracted position while being drivable for engaging the garment 4, at least drivable in the extended position. In FIG. 4*a*, respective engaging member axes A have been indicated as examples for one exemplary engaging member 24*a* and for another exemplary engaging member 24*b*. It will be appreciated that respective engaging member axes can thus be defined for each engaging member 24*a*, 24*b*.

In an embodiment, with continued reference to FIG. 4*a*, the at least one engaging member 24*a*, 24*b* comprises one or more wheels 24*a* for engaging at least part of the compressive garment 4 at a respective wheel surface, the one or more wheels 24*a* each being rotatably drivable about a respective wheel axis W (an example of which is shown in FIG. 4*a*) which extends at an angle with the main ring axis R.

Such one or more wheels 24*a* can advantageously stretch and/or position the garment 4 radially outwardly and axially onto the circumferential wall 10, thereby in particular passing an edge 14 of the wall. For engagement with the garment 4, the wheel surface is preferably configured to resist tangential movement of the garment 4 with respect to the wheel surface. To that end, the wheel surface is preferably configured to induce friction with the garment 4, for example through a suitable wheel surface structure and/or material.

In an embodiment, see for example FIG. 3*a* together with FIG. 2*b*, the one or more wheels 24*a* are arranged for extending through the at least one first passage 12*a* when the at least one wheel 24*a* is in the extended position.

In an embodiment, the at least one engaging member 24*a*, 24*b* comprises one or more worm gears 24*b* for engaging at least part of the compressive garment 4 at a respective worm gear surface, the one or more worm gears 24*b* each being rotatably drivable about a respective worm gear axis G (an example of which is shown in FIG. 4*a*) which extends at least axially with respect to the main ring axis R.

Such a worm gear 24*b* can advantageously transport at least part of the garment 4 in a substantially axial direction along an outer surface of the circumferential wall 10, thereby distributing the garment over the wall 10. Such distribution enables a relatively large part of the garment 4 to be positioned onto the ring structure 8 for particularly easy subsequent donning of the garment 4. The worm gear 24*b* may be substantially cylindrical in shape. In an advantageous elaboration (not shown), the worm gears 24*b* are tapered along the worm gear axis G, extending from a wider end at the side of the wheels 24*a* to a narrower opposite end.

In an embodiment, the one or more worm gears 24*b* are arranged for extending through the at least one second passage 12*b* when the at least one worm gear 24*b* is in the extended position.

In an embodiment, in axial direction the one or more wheels 24*a* at least partially overlap with the one or more worm gears 24*b* for transferring at least a part of the compressive garment 4 in axial direction from the one or more wheels 24*a* to the one or more worm gears 24*b*.

An axially substantially continuous garment actuation can thus advantageously be realized with benefit from the above described advantages provided by each of the one or more wheels 24*a* and the one or more worm gears 24*b*.

In an embodiment, the device 22 comprises a driving means 26 for driving the one or more wheels 24*a* and the one or more worm gears 24*b* such that during operation a circumferential wheel speed of the one or more wheels 24*a* exceeds an axial transport speed of the one or more worm gears 24*b*.

It has been found that good overall engagement of the garment 4 with respect to the ring structure 8 can be realized in this way. Without wishing to be bound by theory, it is believed that this is at least partly associated with creases and/or pleats thus being formed in the garment, in particular in or at an area of axial overlap between the wheels 24*a* and the worm gears 24*b*. Such creases and/or pleats can subsequently be transported along the worm gears 24*b*, thus providing a substantially homogeneous axial distribution of the garment 4 along the circumferential wall 10.

In an embodiment, the one or more wheels 24*a* comprises a plurality of wheels 24*a*, wherein the one or more worm gears 24*b* comprises a plurality of worm gears 24*b*, wherein the wheels 24*a* and worm gears 24*b* are arranged alternatingly along the circumferential direction of the ring structure 8.

The garment 4 can thus be engaged and transported substantially homogeneously with respect to the ring structure's 8 circumference.

In an embodiment, the number of wheels 24*a* of the plurality of wheels 24*a* is in the range of four to eight, preferably six, wherein the number of worm gears 24*b* of the plurality of worm gears 24*b* is the same as the number of wheels 24*a* or one more or one less.

Good results have been obtained with such a configuration, while providing a relatively simple device structure.

In an embodiment, the device 22 is provided with a tapered, e.g. conical, shape towards a garment receiving axial end 28 thereof (see e.g. FIGS. 3*a*-*b*) for guiding the compressive garment 4 towards the at least one engaging member 24*a*, 24*b*.

In an embodiment, as shown in FIGS. 9*a*-*b* and 10, the garment receiving axial end 28 is provided with a circumferential array of spring-loaded hooks 44 for at least selectively resisting movement of the garment towards the axial end 28 away from the at least one engaging member 24*a*, 24*b*.

Such hooks 44 may be movable between a retracted position as shown in FIG. 9*b* and an extended position as shown in FIGS. 9*a* and 10, wherein the spring-loaded hooks 44 are preferably biased towards the extended position. Such hooks 44 enable easy initial positioning of the garment 4 onto the axial end 28 of the device 1, in particular for subsequent engagement by the wheels 24*a*. Optionally, the hooks 44 are lockable in the retracted position, for example to prevent the hooks 44 from adversely interacting with the garment 4 while axially removing the ring structure 8 with the garment 4 thereon from the device 1.

In an embodiment, the device 22 is provided with one or more motors 30 for driving the at least one engaging member 24*a*, 24*b*. Alternatively or additionally, the at least one engaging member 24*a* may be hand driven, e.g. using and lever and/or a winch, and/or be powered otherwise.

In an embodiment, the at least one engaging member 24*a*, 24*b* is lockable in its extended position and subsequently unlockable therefrom.

Such a configuration can be realized in various ways, wherein such locking enables robust positioning of the at least engaging member 24*a*, 24*b* with respect to the ring structure 8. Such locking and unlocking may be combined with, e.g. be coupled to, a locking of the spring-loaded hooks 44 as described above, wherein preferably the hooks 44 are locked in their retracted position when the at least one engaging member 24*a*, 24*b* is unlocked, thus being movable to its retracted position. Various locking features as described above are preferably user-operable, for example via a user interaction element, e.g. a button, arranged at the axial end 28 of the device 22. The button may be axially movable or alternatively be rotatable. Instead of a button at the axial end 28 of the device 22, the user interaction element may alternatively be positioned near the bottom of the device and e.g. be embodied as a rotatable ring with a handle to be engaged by a user.

FIGS. 1*a* and 3*a* show a system 32 for donning a compressive garment, comprising the assembly 2 and the device 22.

In an embodiment, as shown in FIG. 6, the system 32 further comprises a support structure 34 for positioning the ring structure 8 with the received compressive garment 4 at an initial donning position, wherein the support structure 34 is configured to clamp at least part of the compressive garment 4 onto the circumferential wall 10 of the ring structure 8 for resisting, at least initially, axial relative movement between the at least part of the compressive garment 4 and the circumferential wall 10.

Such clamping can make it easier to position the garment 4 onto a body part BP, in particular by preventing release of a relatively large part of the garment 4 at once. Such clamping can be provided in various ways, for example by a constricted opening 40 in which the ring structure 8 with garment 4 can be positioned.

In an embodiment, the system further comprises the compressive garment 4, wherein the compressive garment 4 is stretchable from a less stretched circumference which is small compared to a respective circumference of the circumferential wall 10 of the ring structure 8, to a more stretched circumference which is at least equal to the circumference of the circumferential wall 10.

Such compressive garments are known from practice in many varieties and can advantageously be used as part of such a system 32.

In an embodiment, the system further comprises a guiding means 36 (see FIG. 7) for engaging the compressive garment 4 with the at least one engaging member 24*a*, 24*b* of the device 22, wherein the guiding means 36 comprises a further ring structure 38 having an outer diameter d1 which is small compared to an inner diameter d2 of the closed ring structure 8 formed by the set of ring sections 6, 6' of the assembly 2.

Figure 7:
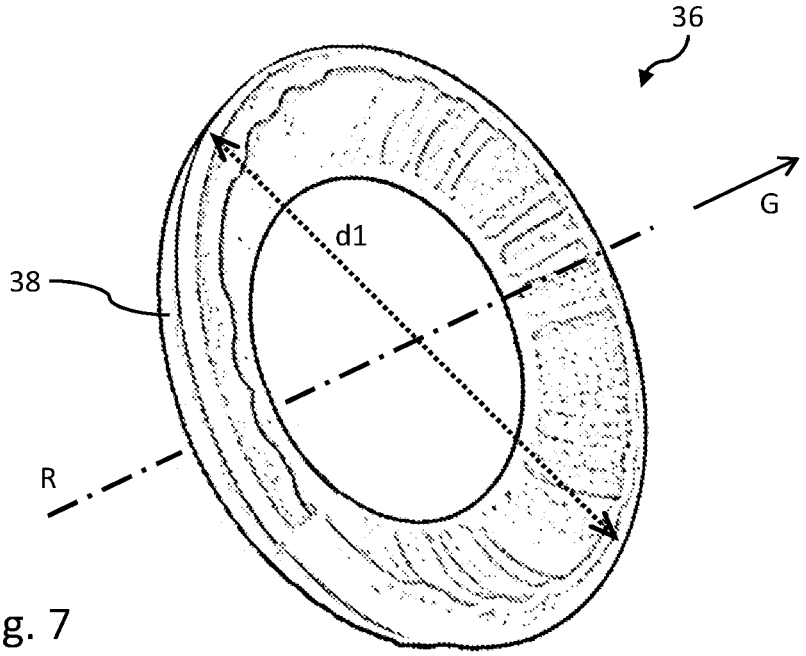
FIG. 7 shows a perspective view of an exemplary guiding means.

Such guiding means 36 can be positioned in the direction G towards the axial end 28 of the device for pushing the garment 4 radially outwards towards engagement with the wheels 24*a*, in particular in a circumferentially substantially homogeneous manner. It should be noted that the further ring structure 38 of the guiding means 36 does not have to be embodied as a closed ring structure as shown in FIG. 7. It is also possible that the further ring structure 38 is not closed so that the compressive garment 4 can be inserted radially into the further ring structure 38. The further ring structure 38 may also be composed of several ring parts.

FIGS. 11-13 show an alternative auxiliary positioning device 48 for initially positioning the compressive garment 4 on a device 22 according to the present disclosure. The auxiliary position device 48 comprises a ring 50 and a plurality of fingers 52. In the example shown in FIGS. 11-13, the fingers 52 are pivotably connected with the ring 50 and are each biased by a spring (not shown) to a radially inwardly moved position as shown in FIGS. 11 and 16. When a radially outwardly directed force is exerted on free tips of fingers 52, the fingers 52 may be moved radially outwardly as shown in FIGS. 12, 13 and 17.

Instead of being pivotally connected to the ring 50, the fingers 52 may alternatively be flexible so that they may flex from a radially inwardly moved position to a radially outwardly moved position when a radially outwardly directed force is exerted on the finger tips.

In an embodiment, the number of fingers 52 may be at least three. Preferably, the number of fingers 52 corresponds to the number of wheels 12*a* and the number of worm gears 12*b* of the device.

A compressive garment 4 may, as shown in FIG. 16 in which the compressive garment 4 is indicated with a dashed line, initially be positioned with a free border 4*a* thereof over the free tips of fingers 52, whereby the remaining part of the compressive garment 4 may extend through the space bounded by the fingers 52 and the ring 50.

In an embodiment, the auxiliary positioning device 48 may have a marking on it. The marking is intended to indicate in which rotational position the free border 4*a* of the compressive garment 4 should be positioned on the auxiliary positioning device 48, namely such that a heel area of the compressive garment 4 is aligned with that marking. The ring structure 8 of the assembly 2 may also have a marking, which indicates to the user how the auxiliary positioning device 48 must be rotatively positioned relative to the ring structure 8. When positioning the marking of the auxiliary positioning device 48 adjacent the marking on the ring structure 8 before transferring the compressive garment 4 from the auxiliary positioning device 48 on the ring structure 8, it is accomplished that, after transfer of the compressive garment 4 on the ring structure 8 of the assembly 2, the heel area of the compressive garment 4 is correctly positioned relative to the handles 20, 20' of the assembly 2. This correct positioning of the compressive garment 4 on the assembly 2 has the benefit that, during inserting of the leg into the compressive garment 4 with the heel area at the right position relative to the leg, the handles 20, 20' of the assembly 2 will be at the lateral sides of the leg which facilitates the insertion of the leg into the compressive garment 4 and facilitates the opening of the ring structure 8 after insertion of the leg into the compressive garment 4.

In an embodiment of the device 22, of which an example is shown in FIGS. 14-17 and 21, the garment receiving axial end 28 of the device 22 may be provided with a number of guiding tracks 54. Preferably, the number of guiding tracks 54 is the same as the number of fingers 52 of the auxiliary positioning device 48. When a user pushes the auxiliary positioning device 48 with the compressive garment 4 thereon on garment receiving axial end 28 of the device 22 with the finger tips of the fingers 52 in the guiding tracks 54, the fingers 52 pivot or flex radially outwardly and will assume the position shown in FIG. 17.

In an embodiment, of which an example is shown in FIGS. 11-13, 16 and 17 an end region of each finger 52 is bend inwardly relative to a remaining part of each respective finger 52, preferably such that the end region of a respective finger 52 substantially extends parallel with the central axis of the auxiliary positioning device 48 when being moved to the radially outwardly moved position as shown in FIGS. 12 and 17. At that point, the free end regions of the fingers 52 are preferably aligned with the circumferential wall 10 of the assembly 2 which is positioned on the device 22, as is clearly visible in FIG. 17. When the wheels 24*a* of the device 22 are rotating, they will engage the compressive garment 4 and pull/push the compressive garment 4 on the circumferential wall 10 of the assembly 2. Thus, the auxiliary positioning device 48 provides a very helpful and easy to use aid for placement of a garment 4 on the circumferential wall 10 of the assembly 2 using the device 22. Because the free ends of the fingers 52 are aligned with the circumferential wall 10 of the assembly 2 when the auxiliary positioning device 48 has been pushed downwardly on the device 22 as shown in FIG. 17, transfer of the compressive garment 4 from the fingers 52 onto the circumferential wall 10 may be smooth.

In fact, the auxiliary positioning device 48 may be used with an embodiment of the device 22 which does not have spring-loaded hooks 44. An example of such an embodiment is shown in FIGS. 14-17 and 21.

In FIG. 14, the device 22 is shown in the expanded position without the assembly 2 being positioned on the device 22. FIG. 14 clearly shows that the housing of the device has an indentation 86 of which the shape corresponds to the shape of the ring structure 8 with the handles 20, 20' of the assembly 2, so that it is immediately clear to the user how the assembly 2 should be positioned on the device 22.

FIG. 15 shows a similar view of the device 22 with the assembly 2 positioned thereon. Clearly visible is that the wheels 24*a* and the worm gears 24*b* protrude through respectively, the first and the second passages 12*a*, 12*b*.

In an embodiment, the device 22 may have a sensor, e.g. a switch, which is actuated by placement of the assembly 2 on the device 22. The device may be configured such that the motor 30 can only be switched on when the sensor is in the actuated state. When no assembly 2 is placed on the device 22, the sensor is not actuated and even if a user tries to switch on the motor 30 of the device 22, it will have no effect. This avoids that a compressive garment 4 is inadvertently placed on the device 22 instead of on the ring structure 8 of the assembly 2 as desired.

In the exemplary embodiment shown in FIGS. 14-17 and 21, the device 22 comprises six segments 56 of the type shown in FIGS. 18-20. FIG. 18 shows a radially inwardly directed side of such a segment 56 and FIG. 19 shows a radially outwardly directed side of the segment 56. FIG. 20 shows a similar view as FIG. 19, be it that an outer housing wall of the segment 56 is removed to show the interior of the segment 56. Each segment 56 has a pivot shaft 58 which is visible in FIG. 18 and with which the segment 56 is pivotally connected with a base part of the device 22 as shown in FIG. 21. Thus, pivoting around the pivot shaft 58 is possible in a similar manner as described above with reference to FIGS. 4*a* and 4*b* and the extension axes E shown therein. A spring 60 of each segment 56 abuts against a base plate 62 of the device 22 and is biases each segment 56 to the radially retracted position. With the operating handle 64 (see FIG. 15), a hub 66 having screw thread 68 is rotated. The screw thread 68 of hub 66 engages screw thread 71 of a tapered operating bush 70. When the hub 66 rotates, the tapered operating bush 70 moves upwardly and downwardly. FIG. 21 shows the operating bush 70 in the upwardly moved position and it is clearly visible that the tapered upper end 70*a* of the operating bush 70 has pushed against an inner edge 72 of each segment 56 to move the segments 56 in the radially extended position. When the operating bush 70 is in a downwardly moved position, a part of the tapered part 70*a* having a smaller diameter engages the inner edge 72 of the segment 56 so that the spring 60 will have biased the segment 56 to a more radially retracted position in which the ring structure 8 of the assembly 2 may be positioned on the device 22 or removed from the device 22.

FIG. 20 clearly shows how the wheel 24*a* and the worm gear 24*b* are each driven via a respective shaft 74, 76. At the lower ends of these shafts 74, 76 gears 78, 80 are provided, which, in this example are engaging each other. As is shown in FIG. 22, one of these gears 78 is driven by a central gear 82 which is mounted on a central shaft 84 of the device 22 (see FIGS. 21 and 22). This central shaft 84 is driven with motor 30 again via another set of gears 88, 90, 92.

It is clear that this is just one example of the many possibilities to drive the wheels 24*a* and worm gears 24*b*. Instead of the planetary gear type construction shown in the example of FIG. 22, use of separate motors for the wheels 24*a* and the worm gears 24*b* is feasible as well. A separate motor or separate set of motors for each segment 56 is also a feasible solution for driving the wheels 24*a* and the worm gears 24*b*. The example of the drive assembly shown in FIGS. 19 to 22 is robust and advantageous from a cost point of view because just a single motor is required for driving all engaging members 24*a*, 24*b* of the device 22.

With reference to the above description regarding the system 32, an exemplary method of donning a compressive garment comprises: providing the system 32; receiving, on the device 22, the closed ring structure 8 formed by the set of ring sections 6, 6' of the assembly 2; engaging at least part of the compressive garment 4 with the at least one engaging member 24*a*, 24*b* of the device 22; and stretching, by the device 22, at least part of the compressive garment 4 radially outwardly with respect to the main ring axis R.

In an embodiment, the method further comprises transporting, by the device 22, a stretched part of the compressive garment 4 axially along the circumferential wall 10 of the ring structure 8.

In an embodiment, the method further comprises: releasing the ring structure 8 with the stretched compressive garment 4 thereon from the device 22; moving a body part BP axially through the ring structure 8 (see FIG. 5 as illustration), thereby at least partly transferring the compressive garment 4 from the ring structure 8 onto the body part BP; and moving the ring sections 6, 6' with respect to each other for opening the ring structure 8 to release the ring structure 8 from the body part BP.

In an advantageous elaboration, releasing the ring structure 8 with the stretched garment 4 thereon from the device 22 comprises driving the wheels 24*a* in a driving direction such that a wheel surface part at the circumferential wall 10 is moved towards the device's axial end 28, which is preferably a reversed direction compared to a wheel driving direction for positioning the garment 4 onto the wall 10. It has been found that release of the ring structure 8 can be made easier in this way.

In an embodiment, the method further comprises: prior to opening the ring structure 8, hinging (see FIG. 2*c*) at least two of the ring sections 6, 6' of the ring structure 8 with respect to each other, thereby increasing a tapering of the ring structure 8 along the main ring axis R, thereby axially releasing at least a part of the compressive garment 4 from the ring structure 8.

In an embodiment, releasing the ring structure 8 from the device 22 comprises retracting the at least one engaging member 24*a*, 24*b* of the device 22 radially inwardly.

In an embodiment, the method further comprises: assembling the closed ring structure 8 from the set of ring sections 6, 6'.

While the invention has been explained using exemplary embodiments and drawings, it will be appreciated that these do not limit the scope of the invention, which scope is provided by the claims. Many variations, combinations, and extensions are possible, as will be appreciated by the skilled person. Examples thereof have been provided throughout the description.

LIST OF REFERENCE SIGNS

2. Assembly
4. Compressive garment
4*a*. Free border of the compressive garment
6, 6'. Ring section
8. Ring structure
10. Circumferential wall
12*a*. First passage
12*b*. Second passage
14. Axial edge of circumferential wall
16, 16'. Hinge
18, 18'. Cam
20, 20'. Handle
22. Device
24*a*. Wheel
24*b*. Worm gear
26. Driving means
28. Axial end of device
30. Motor
32. System
34. Support structure
36. Guiding means
38. Further ring structure
40. Constricted opening
42. Spacing structure
44. Spring loaded hook
46. Flange
48. Auxiliary positioning device
50. Ring
52. Fingers
54. Guiding tracks
56. Segment
58. Pivot shaft
60. Spring
62. Base plate
64. Operating handle
66. Hub
68. Screw tread
70. Operating bush
70*a*. Tapered upper end of operating bush 70
72. Inner edge of a segment 56
74. Shaft driving wheel 24*a*
76. Shaft driving worm gear 24*b*
78. Gear connected with shaft 74
80. Gear connected with shaft 76
82. Central gear
84. Central shaft
86. Indentation
88. Gear
90. Gear
92. Gear
A. Engaging member axis
BP. Body part
d1. Outer diameter of further ring structure
d2. Inner diameter of ring structure
E. Extension axis
G. Worm gear axis
H. Hinging axis
R. Main ring axis
W. Wheel axis

The invention claimed is:

1. An assembly for donning a compressive garment, comprising a set of ring sections together forming an openable closed ring structure which extends around a main ring axis, said ring structure comprising a circumferential wall for receiving a stretched compressive garment thereon, wherein the ring structure is configured for resisting radial compression of the circumferential wall by the received garment, wherein at least two of the ring sections are moveable with respect to each other for opening the ring structure, wherein at least one passage is provided in the circumferential wall of the closed ring structure, wherein the at least one passage comprises a plurality of first passages defined by an axial indentation in an axial edge of the circumferential wall, wherein the at least one passage comprises a plurality of second passages defined by an opening through the circumferential wall, wherein the first and second passages are arranged alternatively along the circumferential direction of the ring structure, wherein each first passage is separate from each second passage, wherein in axial direction each first passage at least partially overlaps with each second passage.

2. The assembly according to claim 1, wherein at least one of the ring sections is provided with one or more connectors, for interfacing with another one of the ring sections for resisting relative movement thereof in at least one of a radial direction and an axial direction.

3. The assembly according to claim 1, wherein at least two of the ring sections are each provided with a respective handle for moving the ring sections with respect to each other, wherein the handles are radially and axially spaced apart from the circumferential wall.

4. An assembly for donning a compressive garment, comprising a set of ring sections together forming an openable closed ring structure which extends around a main ring axis, said ring structure comprising a circumferential wall for receiving a stretched compressive garment therein, wherein the ring structure is configured for resisting radial compression of the circumferential wall by the received garment, wherein at least two of the ring sections are movable with respect to each other for opening the ring structure, wherein at least one passage is provided in the circumferential wall of the closed ring structure, wherein the ring structure comprises one or more hinges for binging two or more of the ring sections with respect to each other, wherein said two or more ring sections are separable from each other at said hinges for opening the ring structure, and wherein the one or more hinges define at least one hinging axis which extends at an angle to the main ring axis, such that the ring structure can be changed between a first shape and a second shape by hinging the two or more ring sections about the at least one hinging axis, wherein, compared to the first shape, the second shape is more tapered along the main ring axis.

5. The assembly according to claim 4, wherein at least one of the ring sections is provided with one or more connectors, for interfacing with another one of the ring sections for resisting relative movement thereof in at least one of a radial direction and an axial direction.

6. The assembly according to claim 4, wherein at least two of the ring sections are each provided with a respective handle for moving the ring sections with respect to each other, wherein the handles are radially and axially spaced apart from the circumferential wall.

7. A device for stretching and positioning a compressive garment onto the circumferential wall of an openable closed ring structure of an assembly for donning the compressive garment, wherein the assembly comprises a set of ring sections together forming the ring structure, which extends around a main ring axis, said ring structure comprising a circumferential wall for receiving the compressive garment thereon, wherein the ring structure is configured for resisting radial compression of the circumferential wall by the compressive garment, wherein at least two of the ring sections are movable with respect to each other for opening the ring structure, wherein at least one passage is provided in the circumferential wall of the ring structure, and wherein the device is configured for receiving the ring structure thereon, and for releasing the ring structure therefrom in an axial direction with respect to the main ring axis of the ring structure, wherein the device comprises at least one engaging member which is configured for engaging at least part of the compressive garment and for moving said at least part of the compressive garment with respect to the circumferential wall, wherein the at least one engaging member is moveable between a radially retracted position and a radially extended position, wherein in the extended position the engaging member at least partly extends radially outwardly through the at least one passage of the circumferential wall, and wherein in the retracted position the engaging member extends less or not through said passage.

8. The device according to claim 7, wherein the at least one engaging member is rotatably drivable about a respective engaging member axis, said axis being radially moveable with respect to the main ring axis between a first position in which the respective engaging member is in the retracted position and a second position in which the respective engaging member is in the extended position.

9. The device according to claim 7, wherein the at least one engaging member comprises a plurality of wheels for engaging at least part of the compressive garment at a respective wheel surface, each wheel of said plurality of wheels being rotatably drivable about a respective wheel axis which extends at an angle with the main ring axis.

10. The device according to claim 9, wherein the at least one passage of the assembly with which the device cooperates comprises a plurality of first passages defined by an axial indentation in an axial edge of the circumferential wall, and comprises a plurality of second passages defined by an opening through the circumferential wall, wherein the first and second passages are arranged alternatingly along the circumferential direction of the ring structure, wherein each first passage is separate from the each second passage, wherein in axial direction each first passage at least partially overlaps with each second passage, wherein each wheel is arranged for extending through an associated first passage of the plurality of first passages when the at least one wheel is in the extended position.

11. The device according to claim 7, wherein the at least one engaging member comprises a plurality of worm gears for engaging at least part of the compressive garment at a respective worm gear surface, each worm gear of said plurality of worm gears being rotatably drivable about a respective worm gear axis which extends at least axially with respect to the main ring axis.

12. The device according to claim 11, wherein the at least one passage of the assembly with which the device cooperates comprises a plurality of first passages defined by an axial indentation in an axial edge of the circumferential wall, and comprises a plurality of second passages defined by an opening through the circumferential wall, wherein the first and second passages are arranged alternatingly along the circumferential direction of the ring structure, wherein each first passage is separate from the each second passage, wherein in axial direction each first passage at least partially overlaps with each second passage, wherein each worm gear is arranged for extending through an associated second passage of the plurality of second passages when the at least one worm gear is in the extended position.

13. The device according to claim 12, wherein the at least one engaging member comprises a plurality of wheels for engaging at least part of the compressive garment at a respective wheel surface, each wheel of said plurality of wheels being rotatably drivable about a respective wheel axis which extends at an angle with the main ring axis, wherein each wheel is arranged for extending through an associated first passage of the plurality of first passages when the at least one wheel is in the extended position, wherein in axial direction the wheels of the plurality of wheels at least partially overlap with the worm gears of the plurality of worm gears for transferring at least a part of the compressive garment in axial direction from the wheels to the worm gears.

14. The device according to claim 13, comprising a driving means for driving the wheels and the worm gears such that during operation a circumferential wheel speed of the wheels exceeds an axial transport speed of the worm gears.

15. The device according to claim 13, wherein the wheels and worm gears are arranged alternatingly along the circumferential direction of the ring structure.

16. The device according to claim 7, provided with one or more motors for driving the at least one engaging member.

17. The device according to claim 7, wherein the at least one engaging member is lockable in its extended position and subsequently unlockable therefrom.

18. A system for donning a compressive garment, comprising the device according to claim 7 and the assembly.

19. The system according to claim 18, further comprising a support structure for positioning the ring structure with the received compressive garment at an initial donning position, wherein the support structure is configured to clamp at least part of the compressive garment onto the circumferential wall of the ring structure for resisting, at least initially, axial relative movement between said at least part of the compressive garment and the circumferential wall.

20. The system according to claim 18, further comprising the compressive garment, wherein the compressive garment is stretchable from a less stretched circumference which is small compared to a respective circumference of the circumferential wall of the ring structure, to a more stretched circumference which is at least equal to said circumference of the circumferential wall.

21. A method of donning a compressive garment, comprising:

providing the system according to claim 18;

receiving, on the device, the closed ring structure formed by the set of ring sections of the assembly;

engaging at least part of the compressive garment with the at least one engaging member of the device; and stretching, by the device, at least part of the compressive garment radially outwardly with respect to the main ring axis.

22. The method according to claim 21, further comprising:

transporting, by the device, a stretched part of the compressive garment axially along the circumferential wall of the ring structure.

23. The method according to claim 21, further comprising:

releasing the ring structure with the stretched compressive garment thereon from the device;

moving a body part axially through the ring structure, thereby at least partly transferring the compressive garment from the ring structure onto said body part; and moving the ring sections with respect to each other for opening the ring structure to release the ring structure from the body part.

24. The method according to claim 23, further comprising:

prior to opening the ring structure, hinging at least two of the ring sections of the ring structure with respect to each other, thereby increasing a tapering of the ring structure along the main ring axis, thereby axially releasing at least a part of the compressive garment from the ring structure.

25. The method according to claim 23, wherein releasing the ring structure from the device comprises retracting the at least one engaging member of the device radially inwardly.

* * * * *